US011737571B2

(12) United States Patent
Griggs, Jr.

(10) Patent No.: US 11,737,571 B2
(45) Date of Patent: Aug. 29, 2023

(54) SYSTEM FOR DENSE PACKING OF READY-TO-ASSEMBLE ARTICLES OF FURNITURE

(71) Applicant: Billy Joe Griggs, Jr., Pulaski, TN (US)

(72) Inventor: Billy Joe Griggs, Jr., Pulaski, TN (US)

( * ) Notice: Subject to any disclaimer, the term of this patent is extended or adjusted under 35 U.S.C. 154(b) by 75 days.

(21) Appl. No.: 16/104,900

(22) Filed: Aug. 18, 2018

(65) Prior Publication Data

US 2019/0053629 A1 Feb. 21, 2019

Related U.S. Application Data

(60) Provisional application No. 62/547,129, filed on Aug. 18, 2017.

(51) Int. Cl.

| | |
|---|---|
| ***A47C 17/04*** | (2006.01) |
| ***A47C 4/02*** | (2006.01) |
| ***A47C 1/031*** | (2006.01) |
| ***A47C 13/00*** | (2006.01) |

(52) U.S. Cl.

CPC ..... *A47C 17/04* (2013.01); *A47C 1/031* (2013.01); *A47C 4/028* (2013.01); *A47C 13/005* (2013.01)

(58) Field of Classification Search

CPC ..... B65B 5/04; A47C 17/04; A47C 4/028; A47C 13/005; A47C 1/031; A47C 1/0347; A47C 1/0352; A47C 1/0321; A47C 17/17; A47C 1/124; B65D 2585/647

See application file for complete search history.

(56) References Cited

U.S. PATENT DOCUMENTS 3,706,473 A * 12/1972 Mullen ..... A47B 87/007 297/452.16
3,811,728 A * 5/1974 Redemske ..... A47B 83/00 297/440.14
4,077,666 A * 3/1978 Heumann ..... A47C 13/005 297/248

(Continued)

OTHER PUBLICATIONS

UPS, Keep Your Shipment Packaging to the Right-Size, https://www.ups.com/media/en/CubeOptimizationSalesSheet.pdf (obtained from https://web.archive.org/web/20120201144349/https://www.ups.com/media/en/CubeOptimizationSalesSheet.pdf and published as early as (Feb. 1, 2012)) (Year: 2012).*

(Continued)

*Primary Examiner* — Theodore V Adamos
(74) *Attorney, Agent, or Firm* — Wayne Edward Ramage; Baker Donelson

(57) ABSTRACT

A system for constructing and shipping full-sized (or larger) RTA articles of furniture in a smaller volume, resulting in more efficient and dense packing of multiple articles on standard international cube shipping containers. Each full-sized or larger RTA article of furniture is constructed so that it in a partially assembled state it can be arranged and packed in a shipping box or container of 26.5 inches or less in height and 30.6 inches or less in width. Lengths may vary, but common lengths are 45 inches, 66 inches, and 90 inches. The system thus results in a substantial increase (approximately 33%) in the number of articles of furniture that can be shipped in a single standard international cube shipping container, thereby greatly reducing the shipping cost per article of furniture.

8 Claims, 37 Drawing Sheets

(56) References Cited

U.S. PATENT DOCUMENTS 5,301,491 A * 4/1994 Boardman, Jr. ..... A47C 4/02 53/428
5,867,849 A * 2/1999 Pontrello ..... A47C 3/16 5/2.1
5,890,767 A * 4/1999 Chang ..... A47C 4/02 297/248
6,056,121 A * 5/2000 Olson ..... B65D 5/5059 206/326
6,109,695 A * 8/2000 Kahwaji ..... A47C 4/03 297/313
7,448,689 B2 * 11/2008 Carter ..... A47C 1/124 24/442
10,212,519 B2 * 2/2019 Nelson ..... H04R 5/023
2002/0152727 A1 10/2002 Levin et al.
2003/0173814 A1 * 9/2003 Wieland ..... A47C 4/021 297/440.1
2004/0021359 A1 * 2/2004 Chang ..... A47C 4/024 297/440.23
2004/0095000 A1 * 5/2004 Durling ..... A47C 13/005 297/188.2
2005/0088028 A1 4/2005 Wan et al.
2005/0253430 A1 * 11/2005 George ..... A47C 1/124 297/233
2008/0284228 A1 * 11/2008 Smith ..... A47B 87/007 297/440.14
2011/0233976 A1 * 9/2011 Hanson ..... A47C 4/02 297/217.1
2011/0298340 A1 * 12/2011 Nelson ..... A47C 13/005 312/111
2012/0248843 A1 * 10/2012 Sinchok ..... A47C 4/02 297/440.1
2013/0193728 A1 8/2013 Wang
2014/0103695 A1 * 4/2014 Griggs, Jr. ..... A47C 1/02 297/440.1
2014/0239679 A1 8/2014 Griggs, Jr.
2016/0174715 A1 * 6/2016 Nelson ..... A47C 31/003 297/440.14
2017/0143122 A1 * 5/2017 Nelson ..... A47C 1/0352

OTHER PUBLICATIONS

International Search Report and Written Opinion, PCT/US18/047009, Griggs Jr. (international filing date Aug. 18, 2018).

* cited by examiner

SYSTEM FOR DENSE PACKING OF READY-TO-ASSEMBLE ARTICLES OF FURNITURE

This application claims benefit of and priority to U.S. Provisional Application No. 62/547,129, filed Aug. 18, 2017. The specification, drawings, and complete disclosure of U.S. Provisional Application No. 62/547,129 is incorporated herein in its entirety by specific reference for all purposes.

FIELD OF INVENTION

This invention relates to a mechanism and system for dense packing of a full-size ready-to-assemble article of furniture into a box of specific dimensions so that multiple boxes can be closely packed in a standard shipping container with maximum space utilization.

BACKGROUND OF THE INVENTION

Ready-to-assemble (RTA) furniture is very popular because it can be easier to assemble and relatively inexpensive as compared to fully assembled furniture. RTA furniture can be packaged in a partially assembled state for rapid assembling to a fully assembled state with minimal effort and tools.

However, while the article of RTA furniture in the partially assembled state occupies less packaging volume for shipping than in the fully assembled state, or a comparable non-RTA article of furniture, the construction of prior art RTA furniture limits the possible reduction in volume. This creates a problem with inefficient use of space and the number of articles of full-sized furniture that can be shipped in a standard international cube intermodal shipping container, which has the exterior dimensions of 40 feet in length, 8 feet in width, and 9 feet in height, with inside dimensions of 474 inches (length), 92 inches (width) and 106 inches (height). Further reductions in shipping volume require unacceptable reductions in furniture size (i.e., the furniture must be reduced to less than full size in assembled form to fit in a smaller carton for shipping).

Accordingly, what is needed is a system for constructing and shipping full-sized (or larger) RTA articles of furniture without reduction in assembled form size in a smaller volume than possible in the prior art with efficient and dense packing on standard international cube shipping containers.

SUMMARY OF THE INVENTION

In various embodiments, the present invention comprises a system for constructing and shipping full-sized (or larger) RTA articles of furniture in a smaller volume, resulting in more efficient and dense packing of multiple articles on standard international cube shipping containers. As described below, each full-sized or larger RTA article of furniture is constructed so that it in a partially assembled (or dis-assembled) state it can be arranged and packed in a shipping box or container of 26.5 inches or less in height and 30.6 inches or less in width. Lengths may vary, but common lengths are 45 inches, 66 inches, and 90 inches. The shipping boxes or containers further are designed to be efficiently and densely packed in the standard intermodal shipping container regardless of orientation or configuration. The present invention thus results in a substantial increase (approximately 33%) in the number of articles of furniture that can be shipped in a single standard international cube shipping container, thereby greatly reducing the shipping cost per article of furniture.

DETAILED DESCRIPTION OF EXEMPLARY EMBODIMENTS

In various embodiments, the present invention comprises a system for constructing and shipping full-sized (or larger) RTA articles of furniture in a smaller volume, resulting in more efficient and dense packing of multiple articles on standard international cube shipping containers. As described below, each full-sized or larger RTA article of furniture is constructed so that it in a partially assembled state it can be arranged and packed in a shipping box or container of 26.5 inches or less in height and 30.6 inches or less in width. Lengths may vary, but common lengths are 45 inches, 66 inches, and 90 inches. The shipping boxes or containers further are designed to be efficiently and densely packed in the standard intermodal shipping container regardless of orientation or configuration. The present invention thus results in a substantial increase (approximately 33%) in the number of articles of furniture that can be shipped in a single standard international intermodal cube shipping container, thereby greatly reducing the shipping cost per article of furniture.

An intermodal container is a large, standardized shipping container, designed for intermodal freight transport, where goods are stored and transported across different modes of transport (e.g., ship, rail, truck) without unloading or reloading of the cargo. The great majority of global intermodal containers are referred to as "dry freight" or "general purpose" steel or metal containers, that come in either nominal 20 or 40 feet standard lengths, with internal width of 92 inches and internal height of 106 inches.

Figure 1:
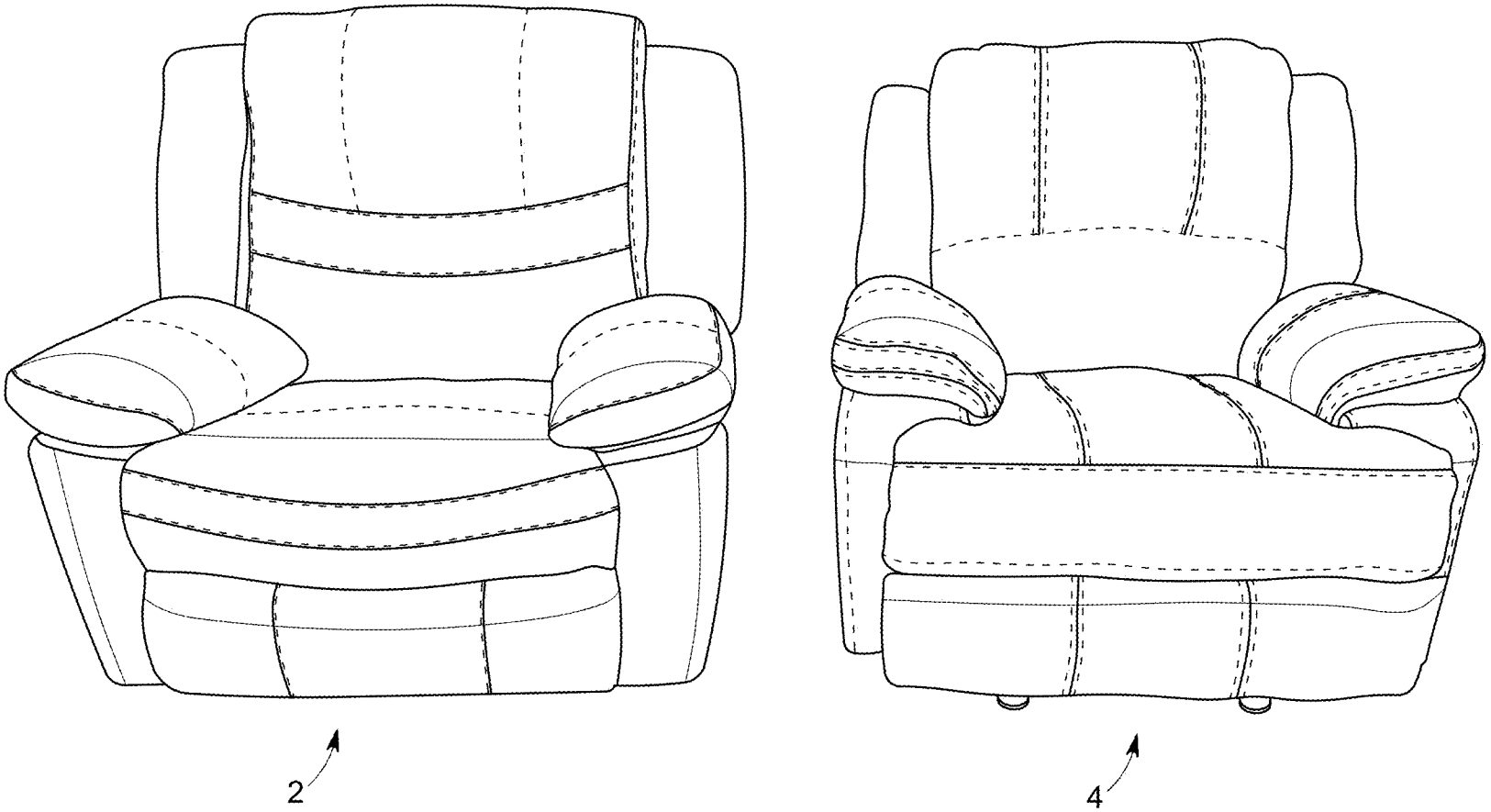
FIG. 1 shows a comparison of a fully assembled full-sized RTA article of furniture in accordance with the present invention compared to a prior art RTA article of furniture.

FIG. 1 shows a comparison of a fully assembled full-sized RTA article of furniture 2 in accordance with the present invention compared to a prior art RTA article of furniture 4. The RTA article of furniture 2 is larger than the prior art article of furniture 4, yet, as described below, can be arranged in a partially assembled state in a smaller volume than the prior art article of furniture. The system and process of disassembling and packing for various articles of furniture is discussed below.

Recliner

Figure 2:
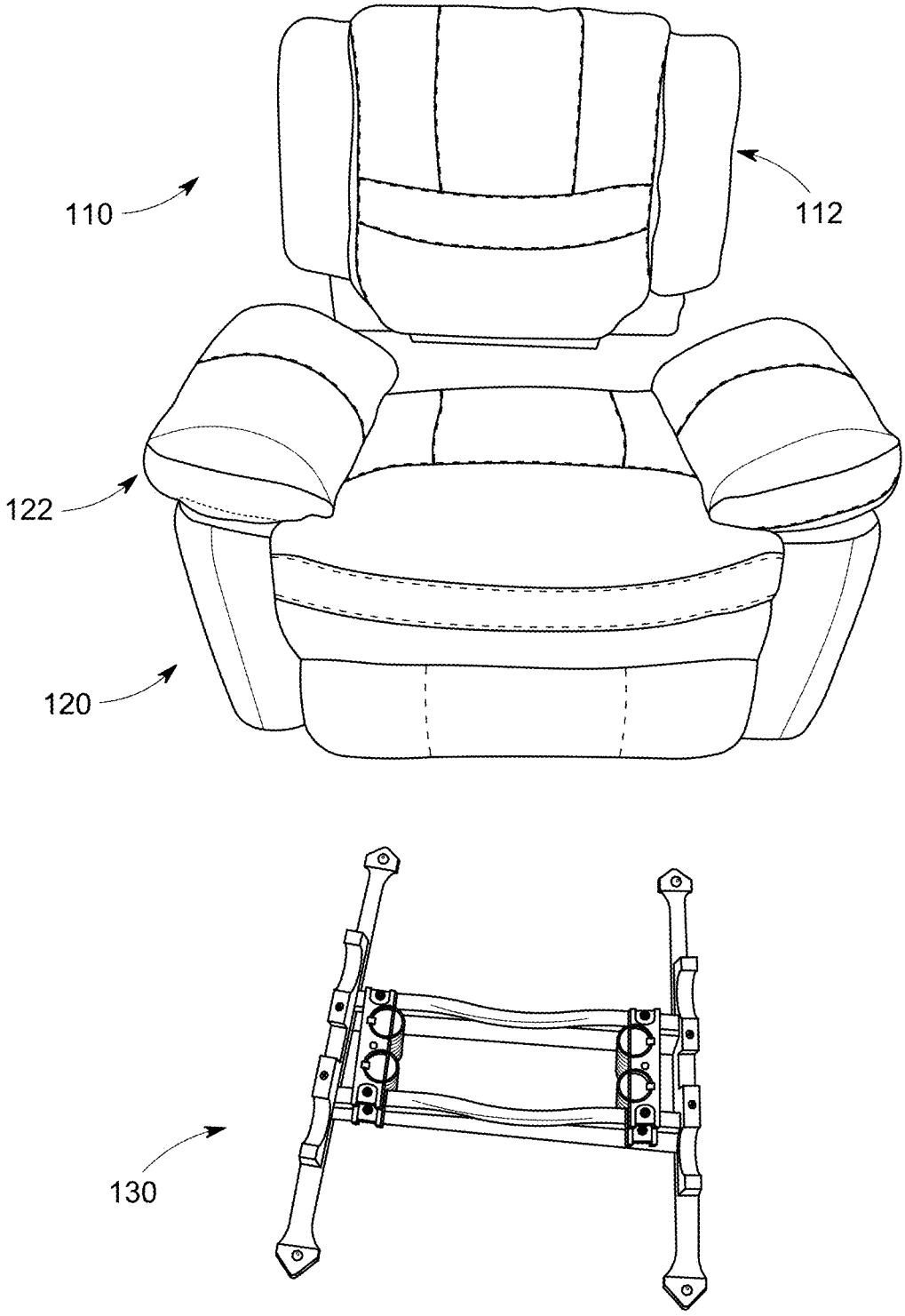
FIGS. 2-7 show the packing process for a full-sized RTA recliner.
Figure 3:
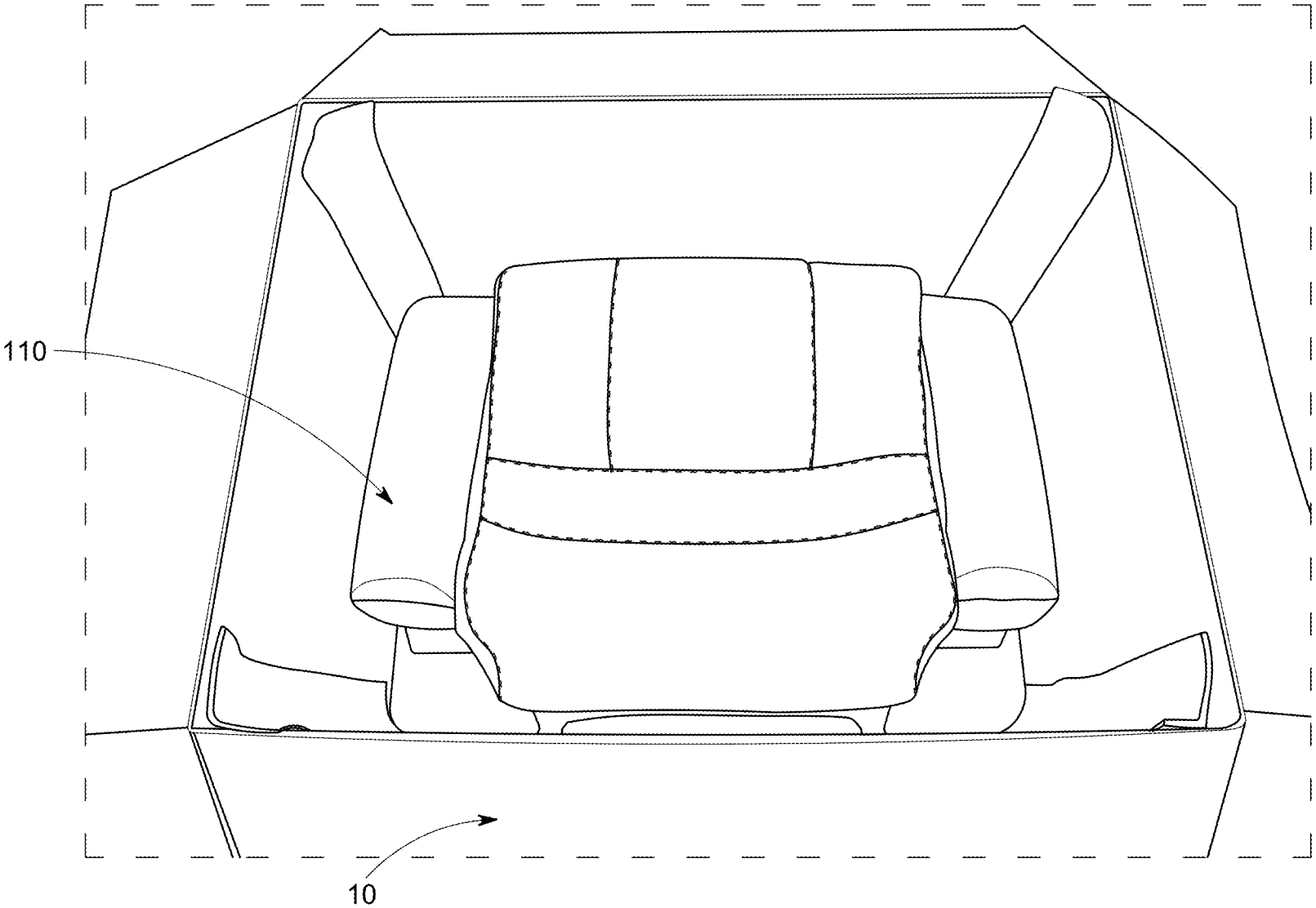
Figure 4:
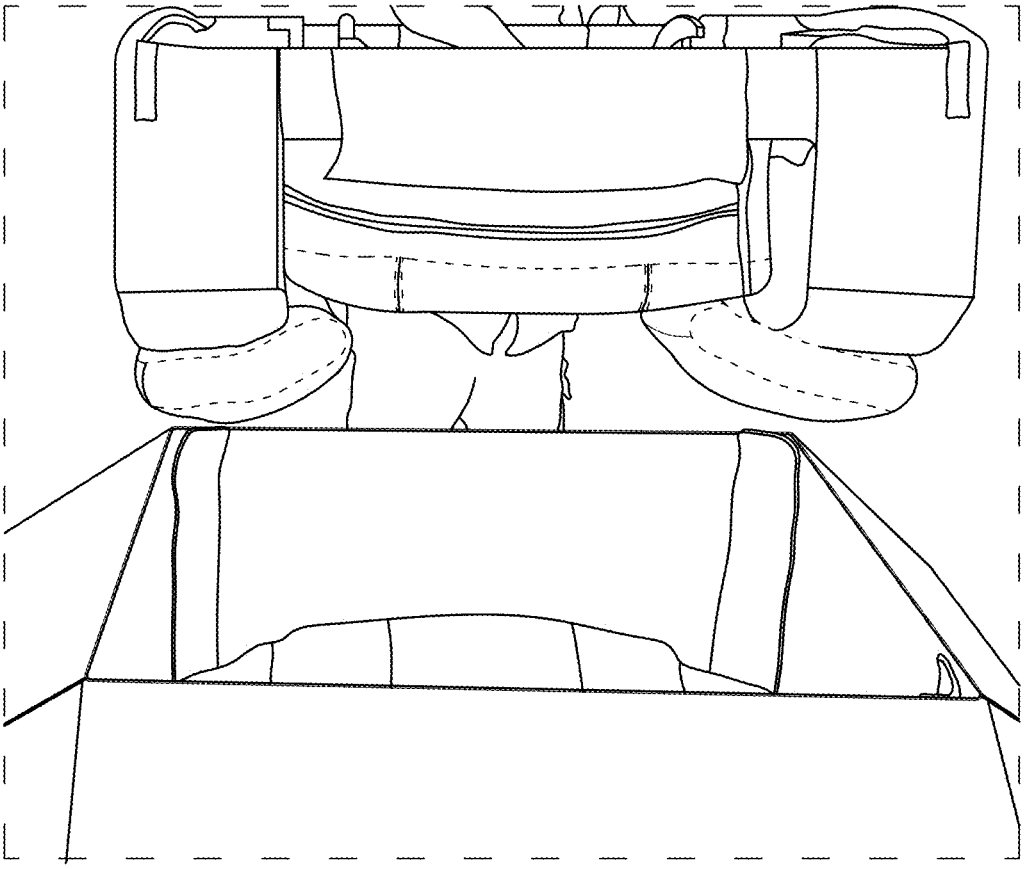
Figure 5:
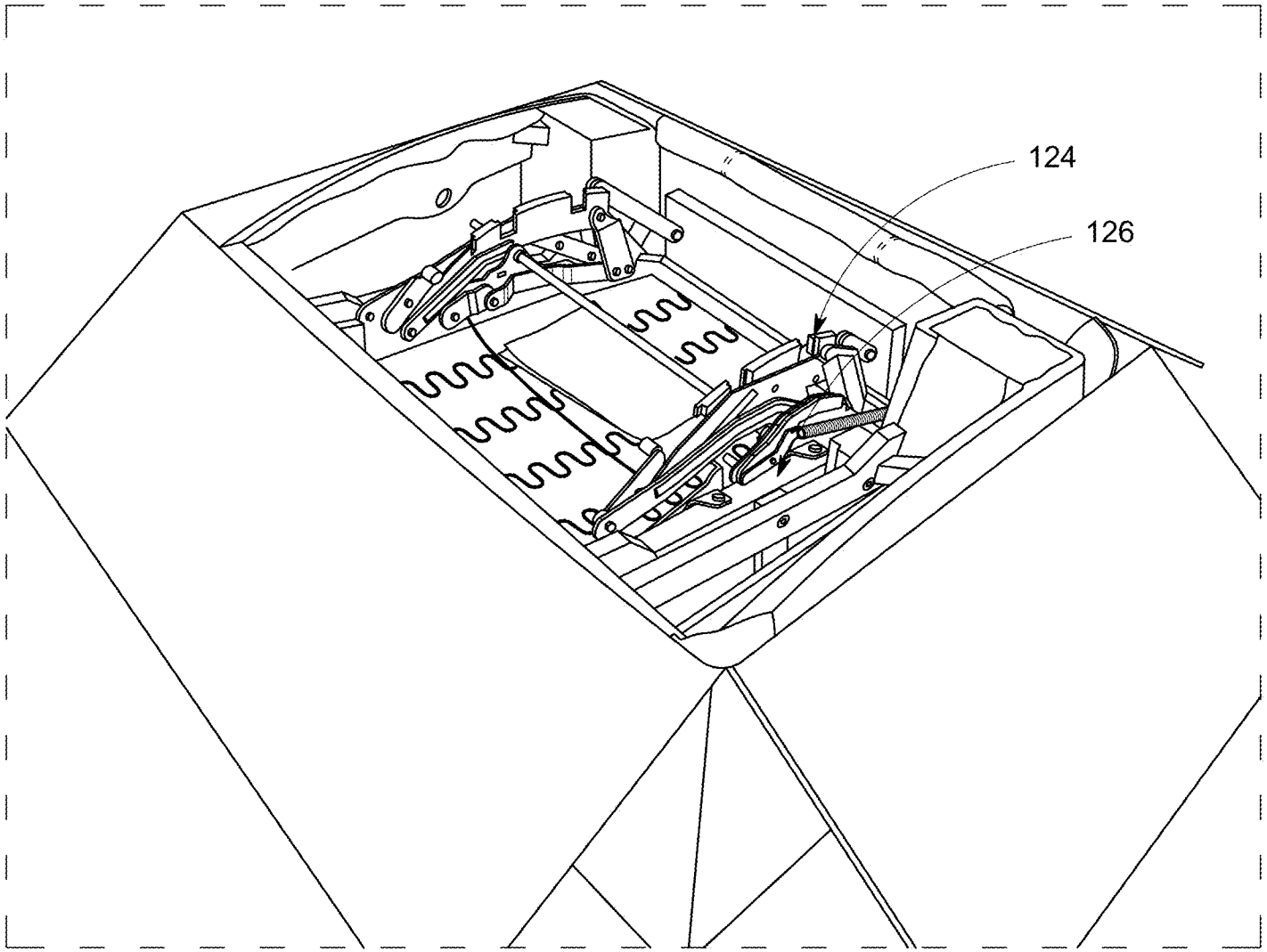
Figure 6:
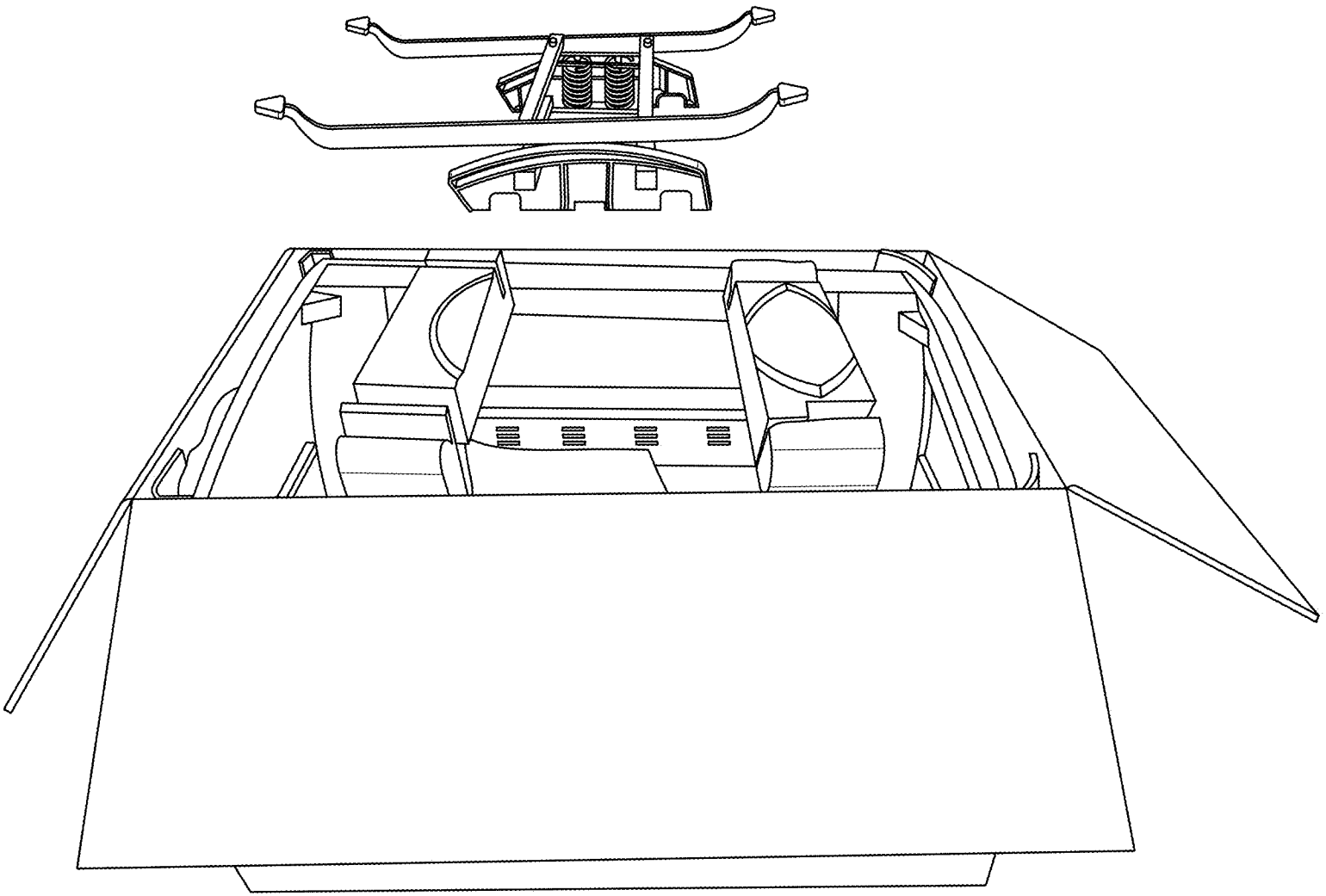
Figure 7:
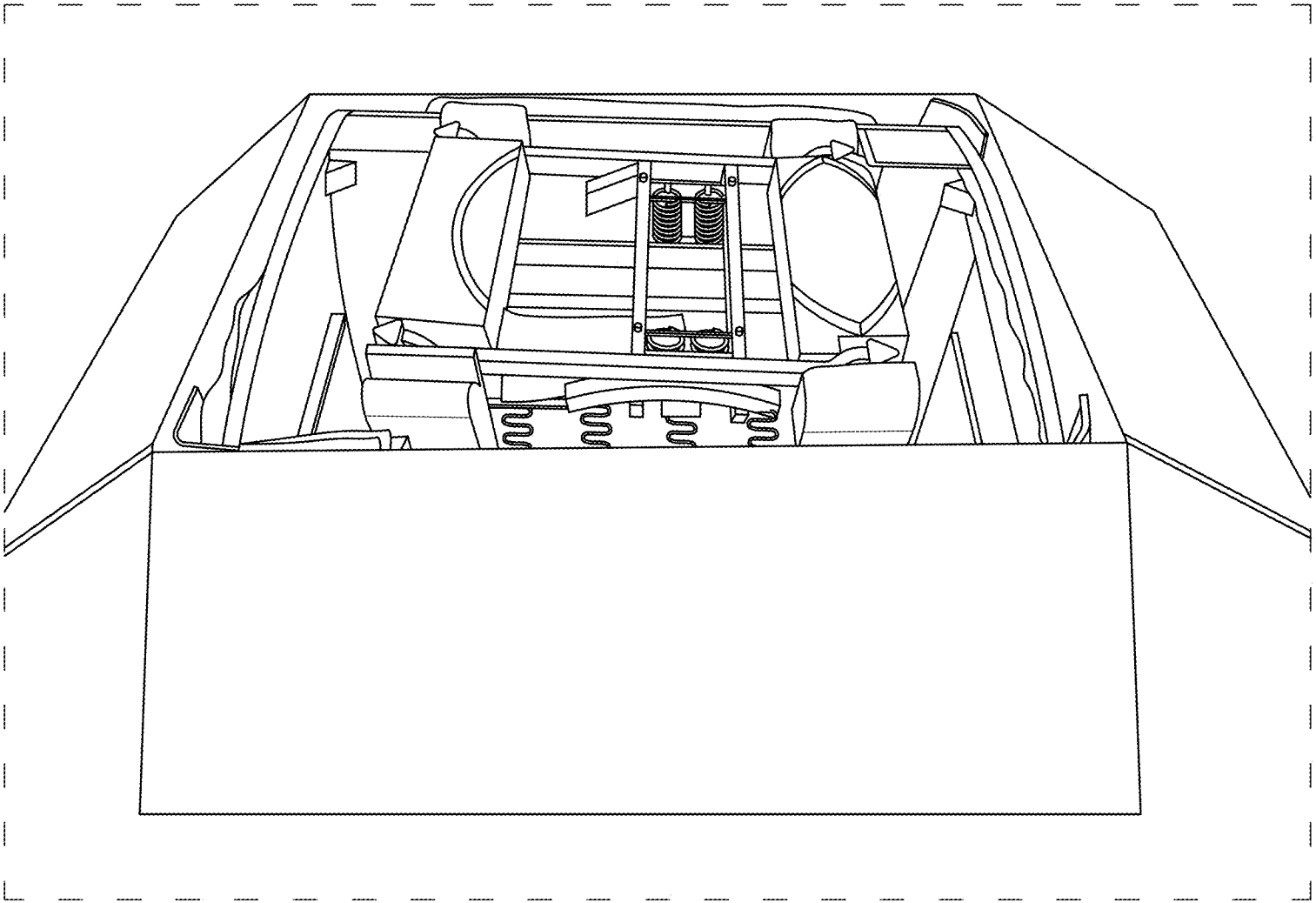

FIG. 1 shows an example of a fully assembled full-sized RTA recliner 1 in accordance with the present invention. FIG. 2 shows the recliner in a partially disassembled state, with the major components comprising a back assembly 110, a seat assembly 120, and a base assembly 130. The back assembly, seat assembly and base assembly are connected by various snap-fit fasteners and connectors, as described in U.S. Provisional Application Nos. 61/758,231 and 62/380,933, and U.S. application Ser. Nos. 14/167,249 and 15/049,767, all of which are incorporated herein by specific reference for all purposes. These fasteners and connectors also are used with the sofa, love-seat and other articles of furniture, as described below.

FIGS. 3-7 show the packing process for packing the recliner in a shipping box or container 10 of 26.5 inches or less in height and 30.6 inches or less in width. First, the back assembly 110 is placed in the bottom of the box with the cushion side up. Then, the seat assembly 120 is inverted and placed in the box with the cushion side down. The seat assembly 120 is arranged so that the arm cushions 122 are placed in alignment with the wing cushions 112 of the back assembly This allows for maximum compression of the cushions while protecting the cushions from damage. It also exposes the bottom of the seat assembly and the scissor elements 126 (which are affixed to the seat assembly) and upper cam piece connectors 124. One or more foam inserts 140 are then placed into position on the bottom of the seat assembly, and the base assembly 130, which includes lower cam piece connectors 134 for a snap-fit RTA connection with the upper cam piece connectors, is rotated 90 degrees and placed securely into corresponding slots or holes in the foam inserts. The box can then be sealed and labeled for shipping.

While this order of packing can be reversed/inverted, so that the back assembly is at the top of the box, this arrangement (i.e., back assembly in the bottom) allows the shipping box to be opened and various base assembles to be removed and added (as described in U.S. patent application Ser. No. 62/380,933, which is incorporated herein in its entirety by specific reference for all purposes) without removing the seat assembly and back assembly from the shipping box.

Sofa

Figure 8:
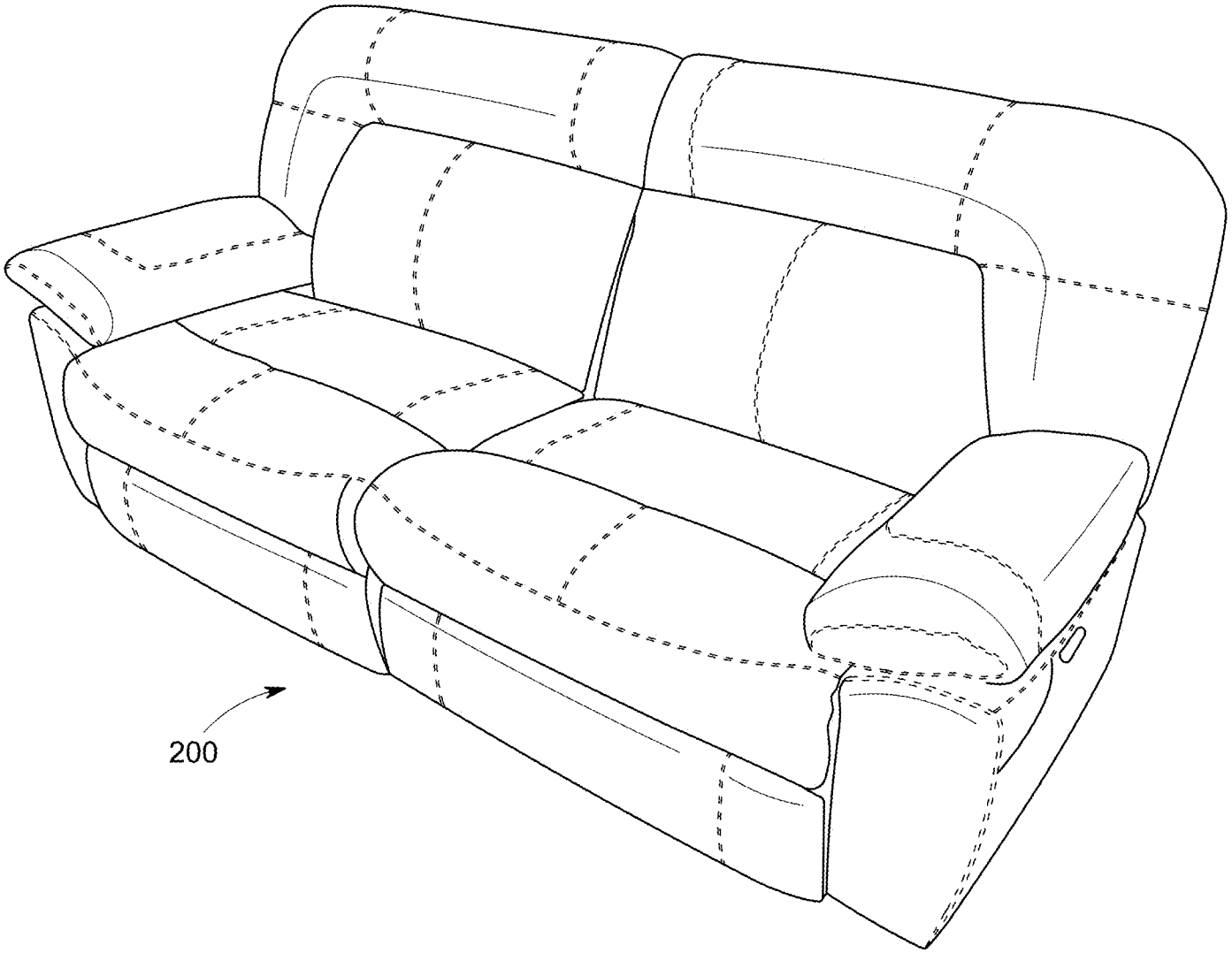
FIGS. 8-12B show the packing process for a full-sized RTA 2-over-2 sofa.
Figure 9:
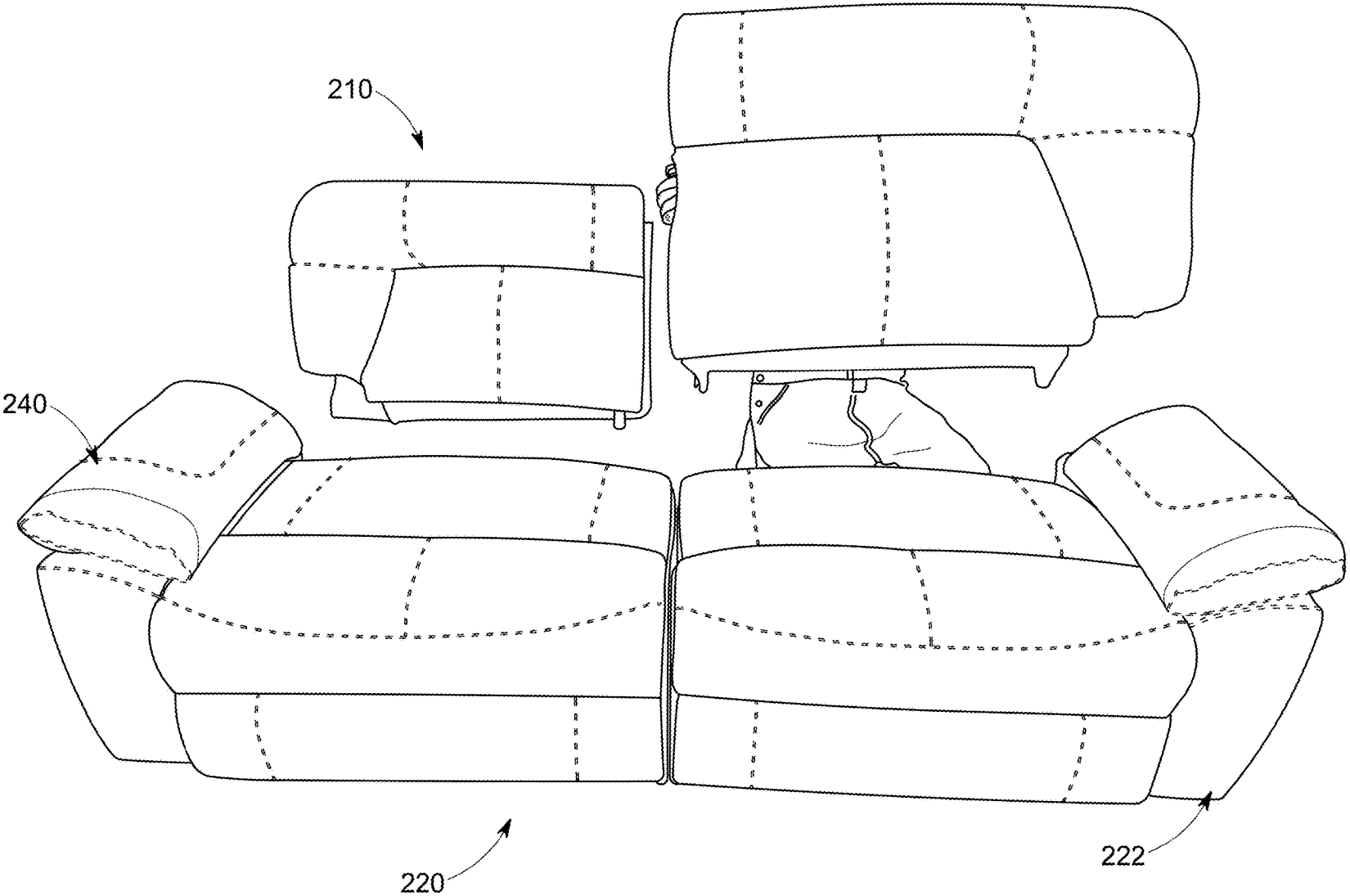
Figure 10:
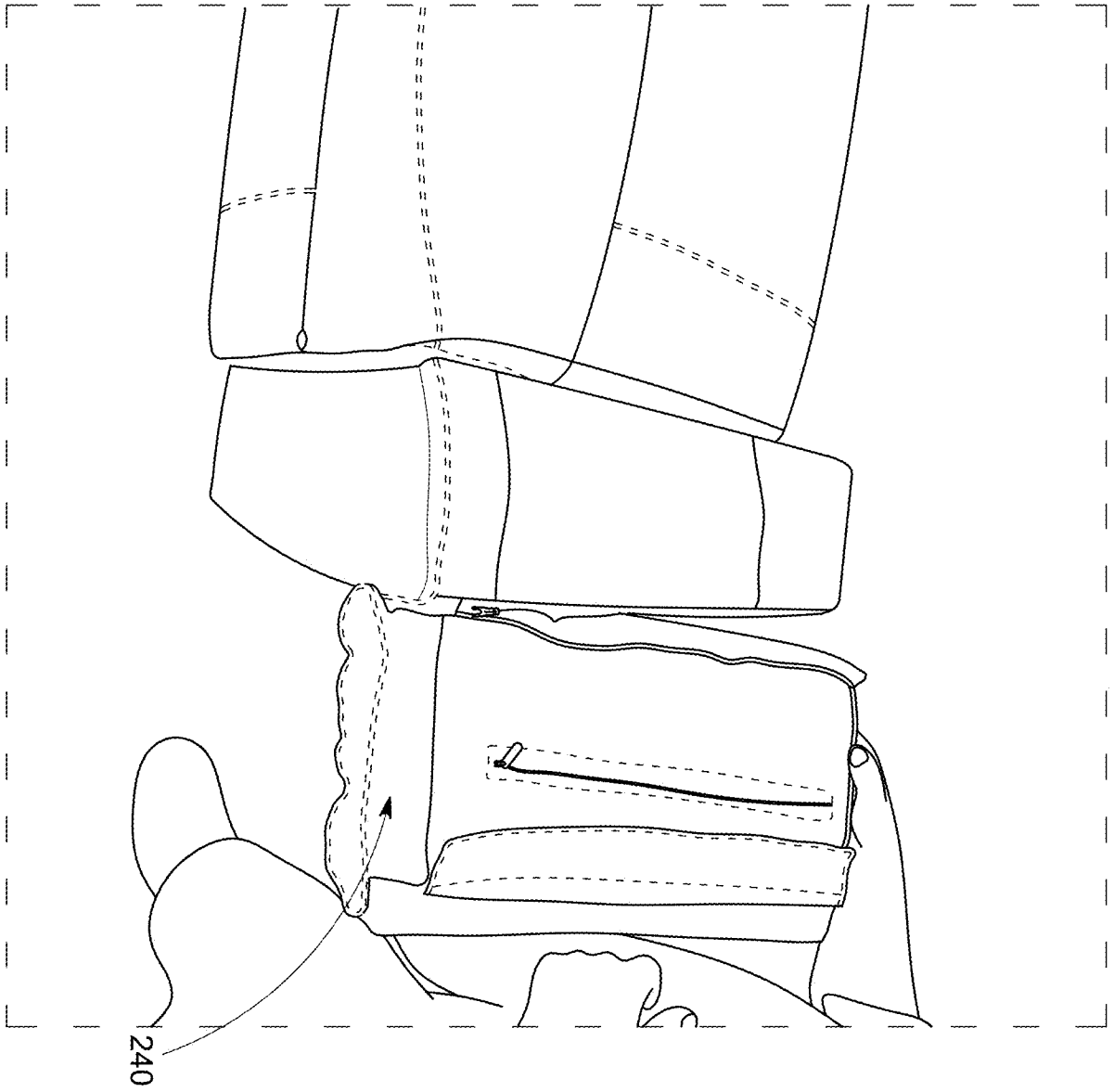

FIG. 8 show a fully assembled "2-over-2" full-sized RTA sofa 200 in accordance with the present invention. FIG. 9 show the sofa in a partially disassembled state, with the major components comprising a back assembly 210, a seat assembly 220, and one or more arm pillows 240. The back assembly and seat assembly and base assembly are connected by various snap-fit fasteners and connectors, as described above. As seen in FIG. 10, the arm pillows 240 may be removably attached to the side arms 222 of the seat assembly by zippers or hook-and-loop fasteners, or the like.

Figure 11:
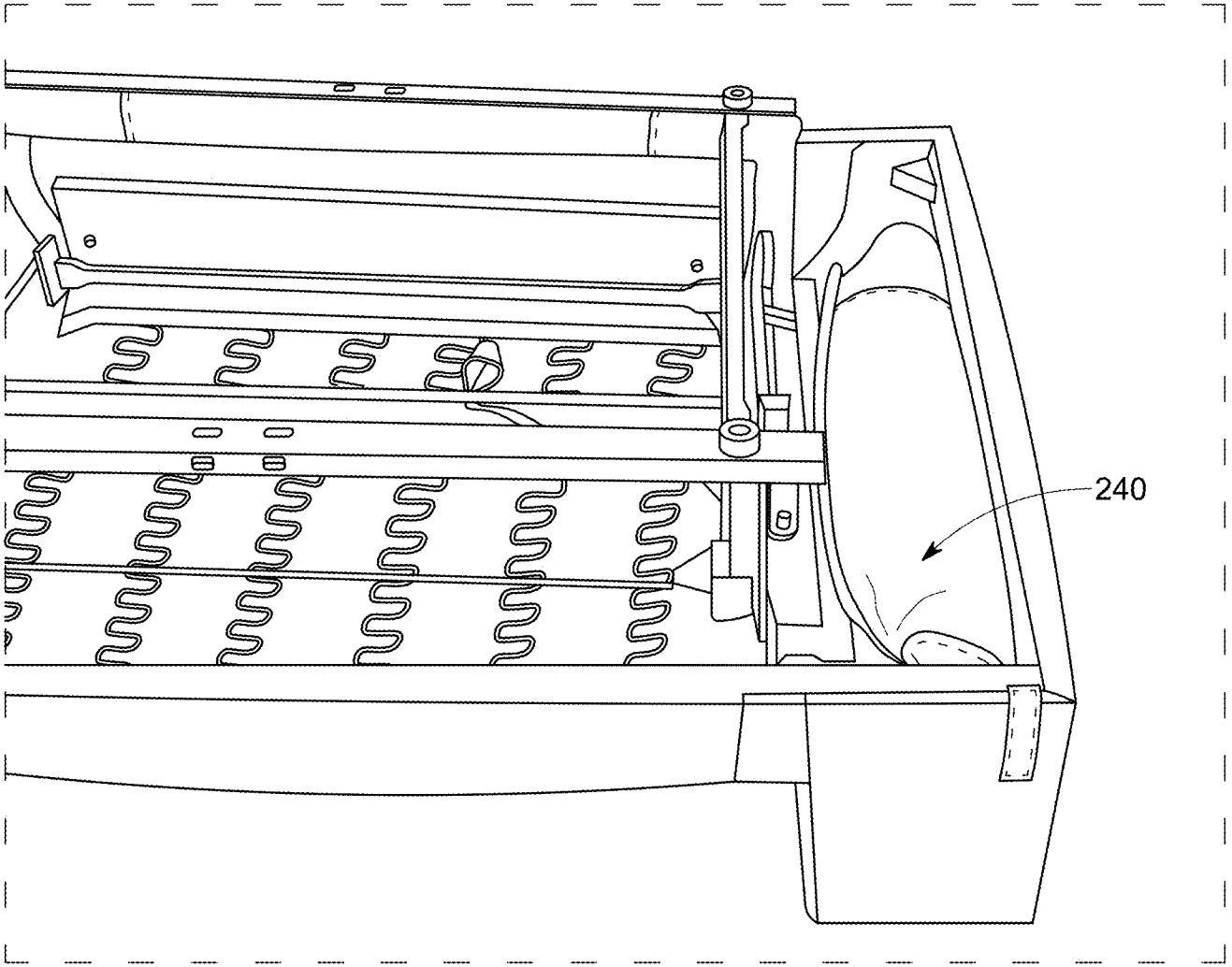
Figure 12B:
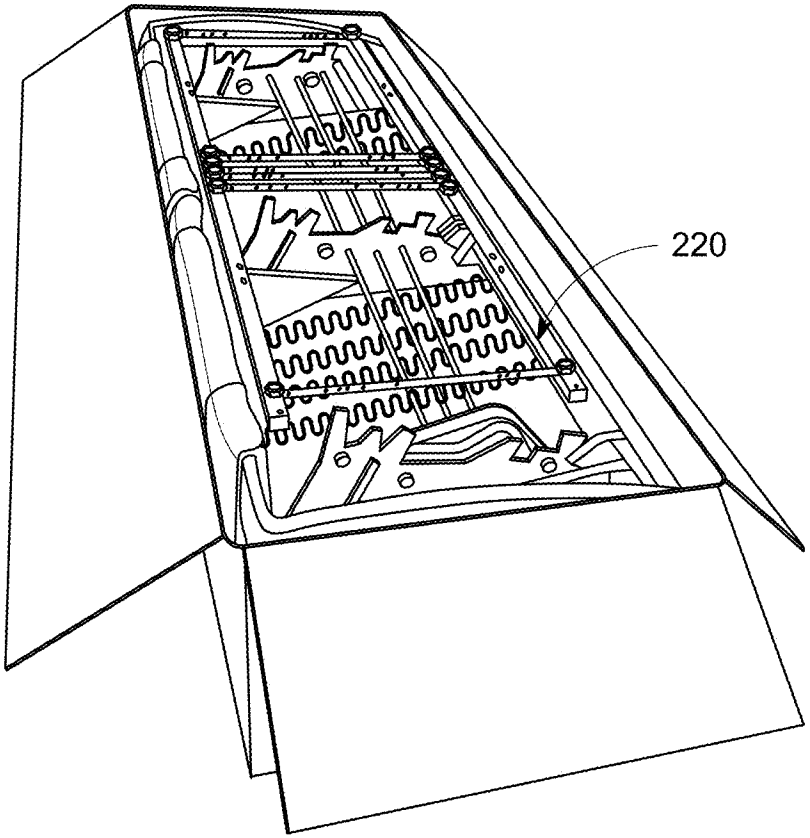
Figure 12A:
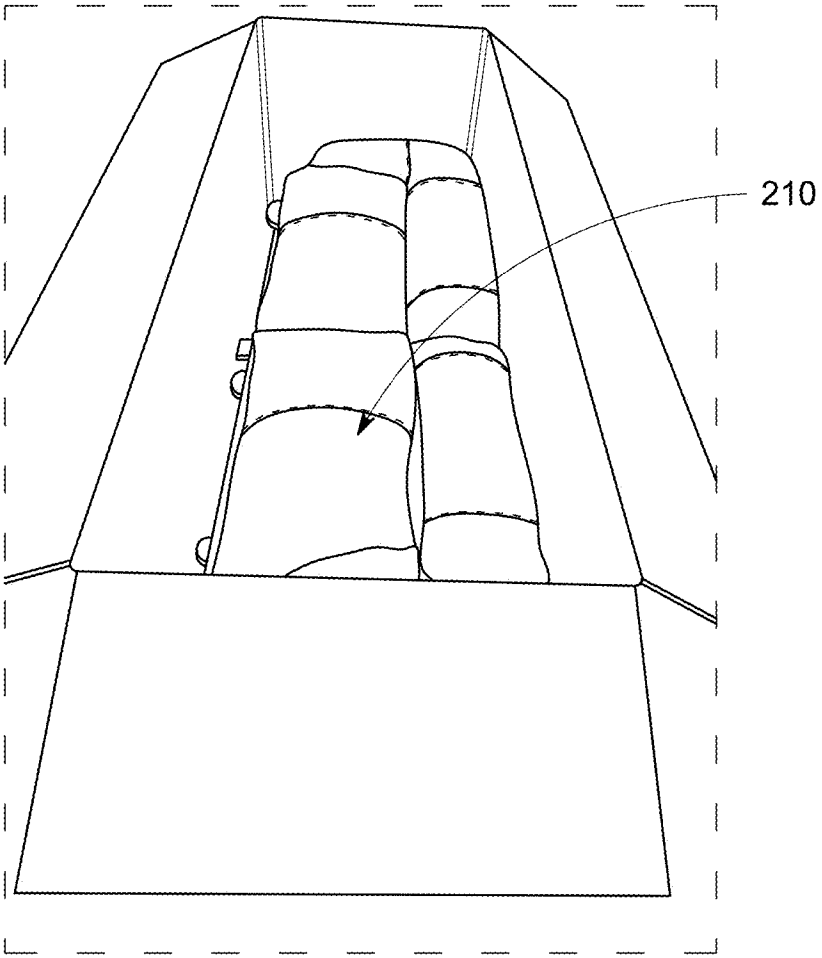

FIGS. 11-12B show the packing process for packing the sofa in a shipping box or container 10 of 26.5 inches or less in height and 30.6 inches or less in width. The arm pillows 240 are removed and inserted into the hollow side arms 222 through openings in the bottom of the side arms, as seen in FIG. 11. The back assembly 210, which may be integrated as a single piece or modular (i.e., divided into parts, i.e., the right and left sides as shown in the figures), is placed into the bottom of the box with the cushion side up. The seat assembly 220, which also may be integrated as a single piece or modular, is inverted and placed over the back assembly, cushion side down. This allows for maximum compression of the cushions while protecting the cushions from damage. The packing order can be inverted. The box can then be sealed and labeled for shipping.

Figure 13:
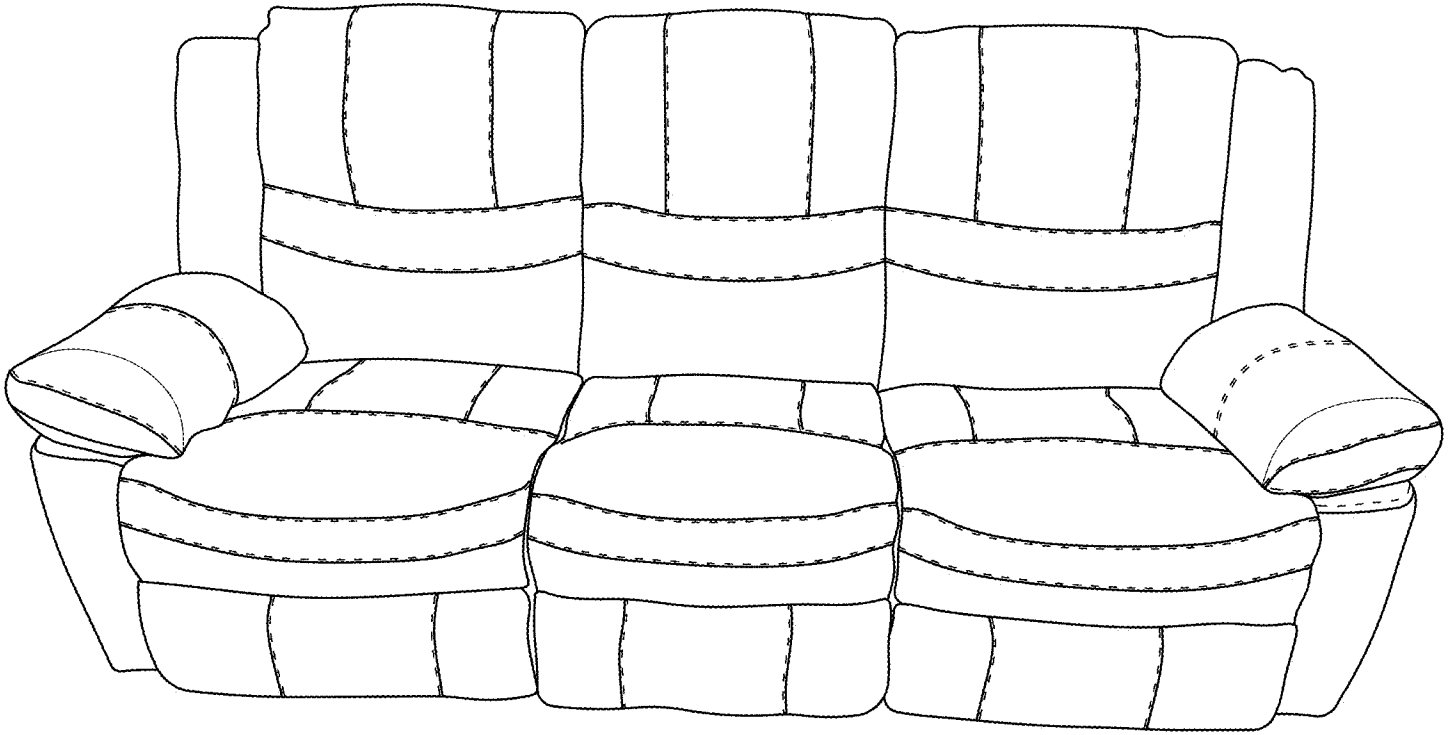
FIGS. 13-15B show the packing process for a full-sized RTA 3-over-3 sofa.
Figure 14:
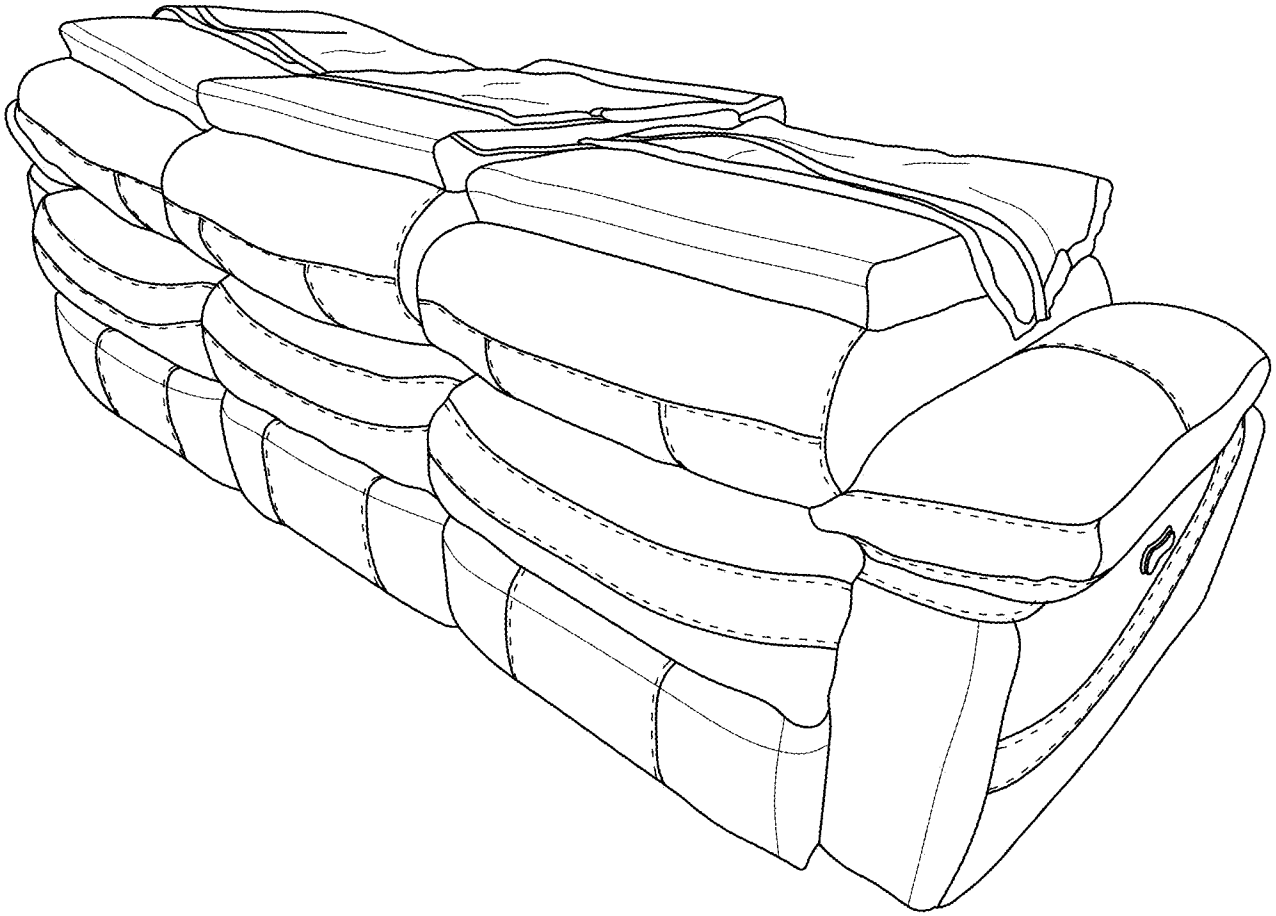
Figure 15B:
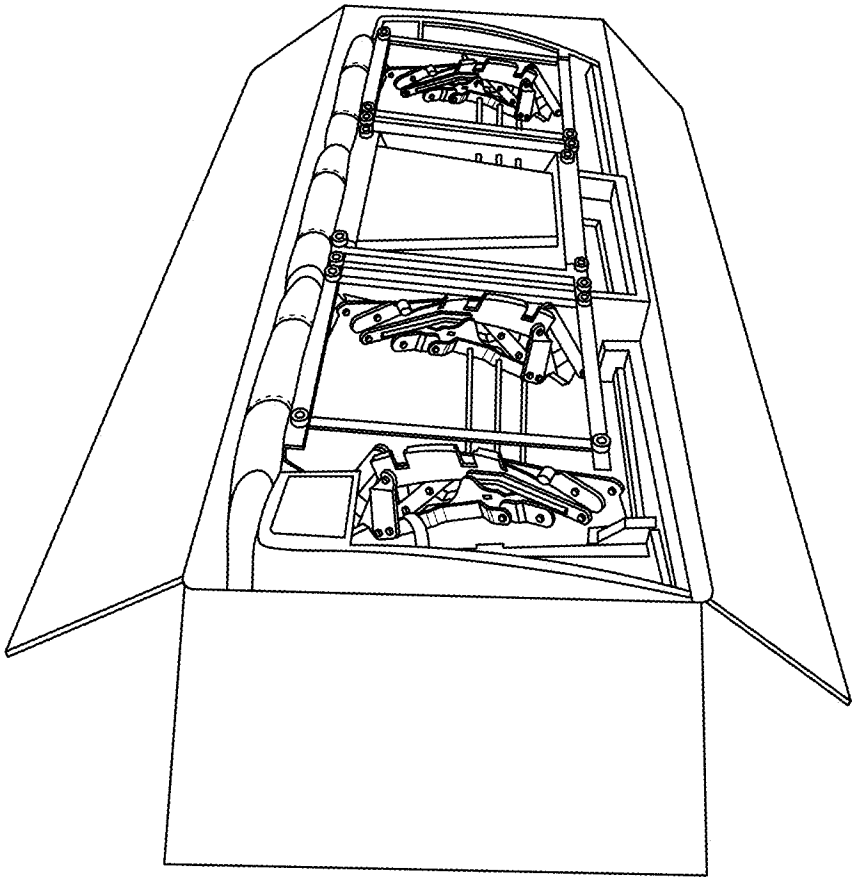
Figure 15A:
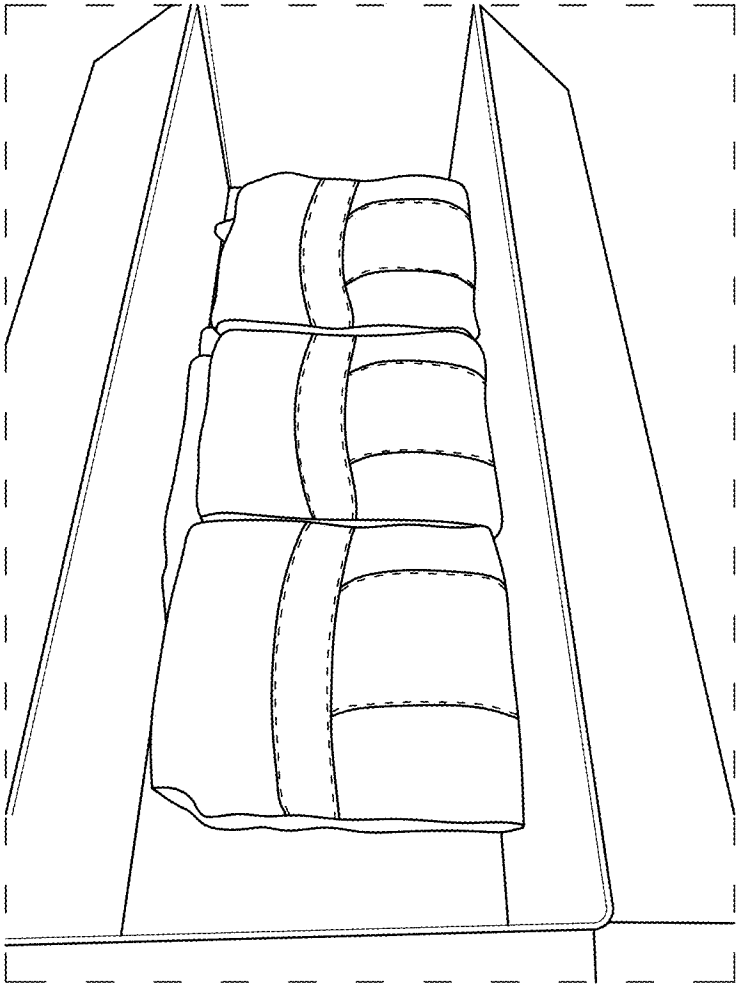
Figure 16A:
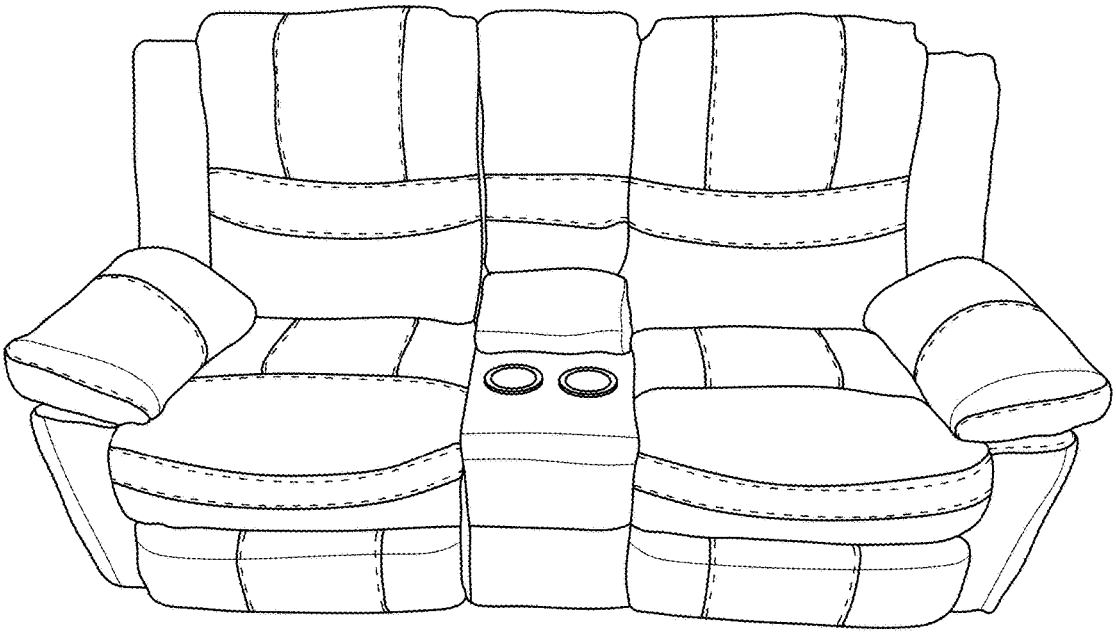
FIGS. 16A-B show the packing process for a full-sized love seat.
Figure 16B:
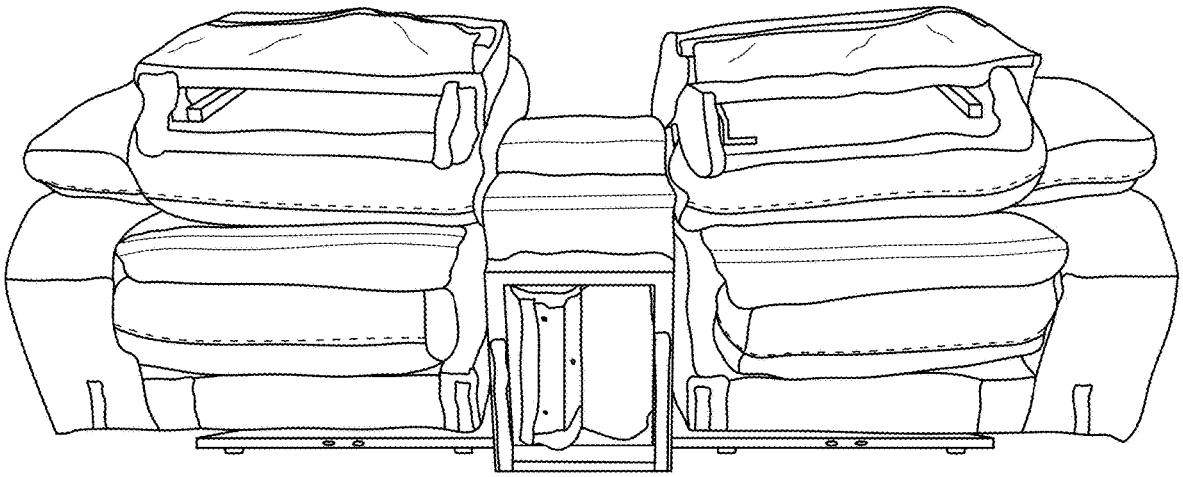
Figure 17A:
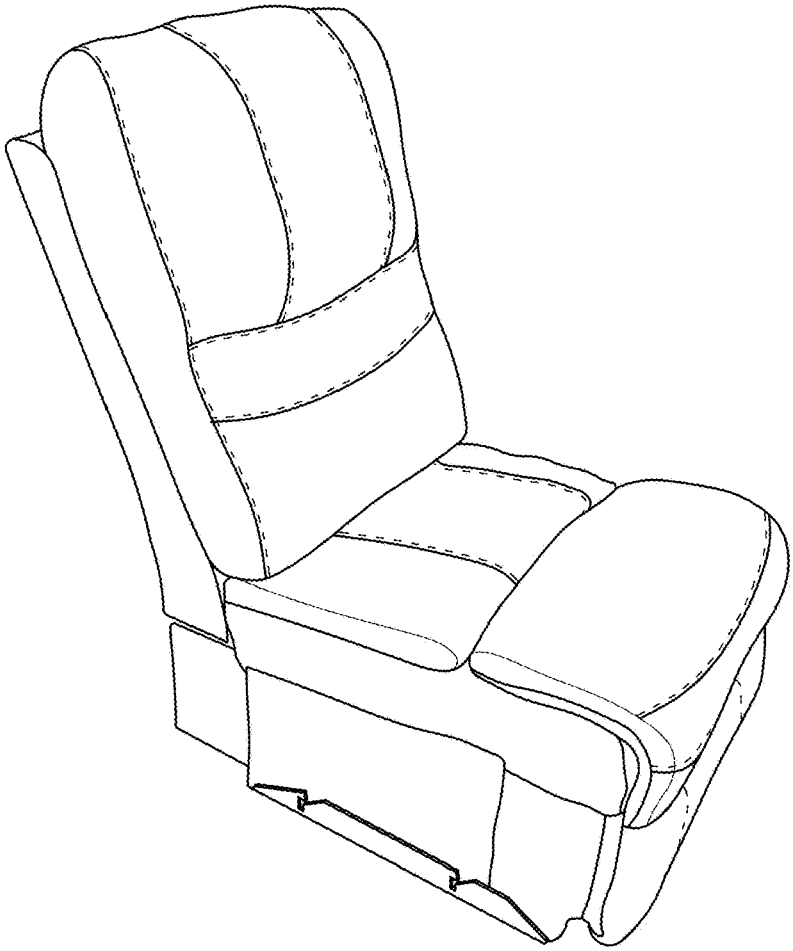
FIGS. 17A-23E show the packing process for modular articles.
Figure 17B:
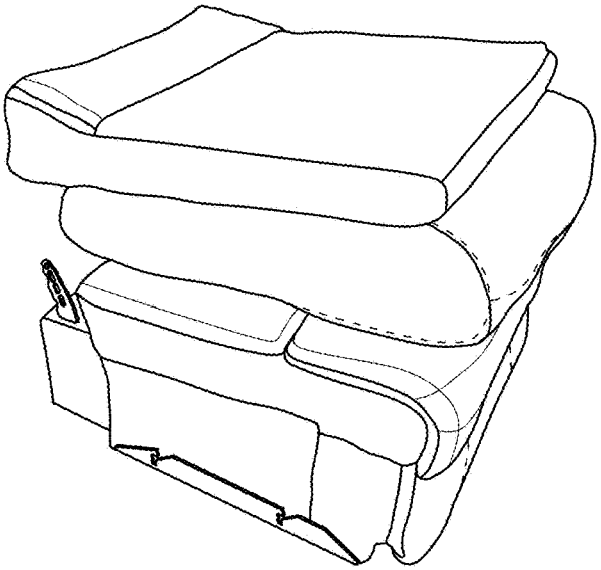
Figure 18A:
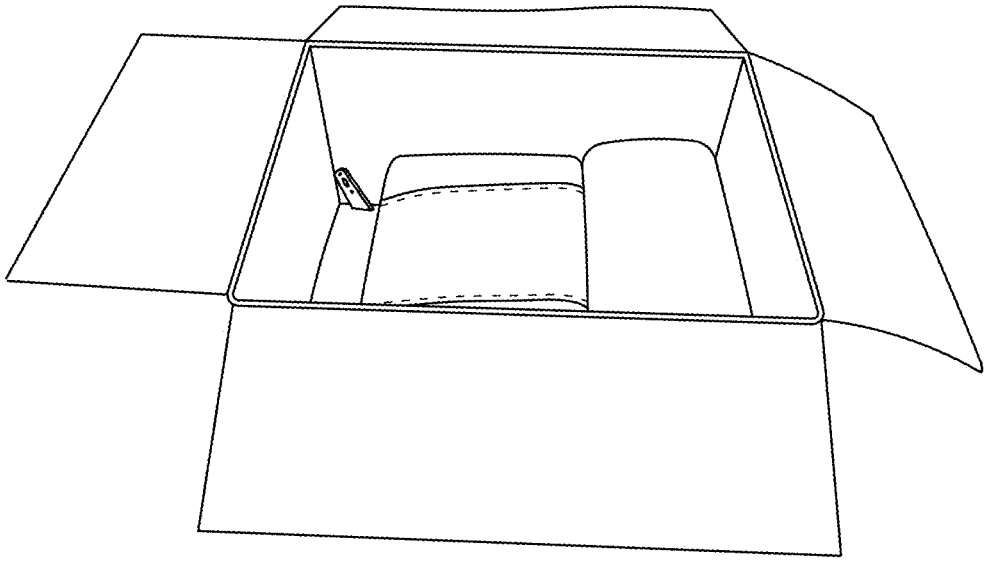
Figure 18B:
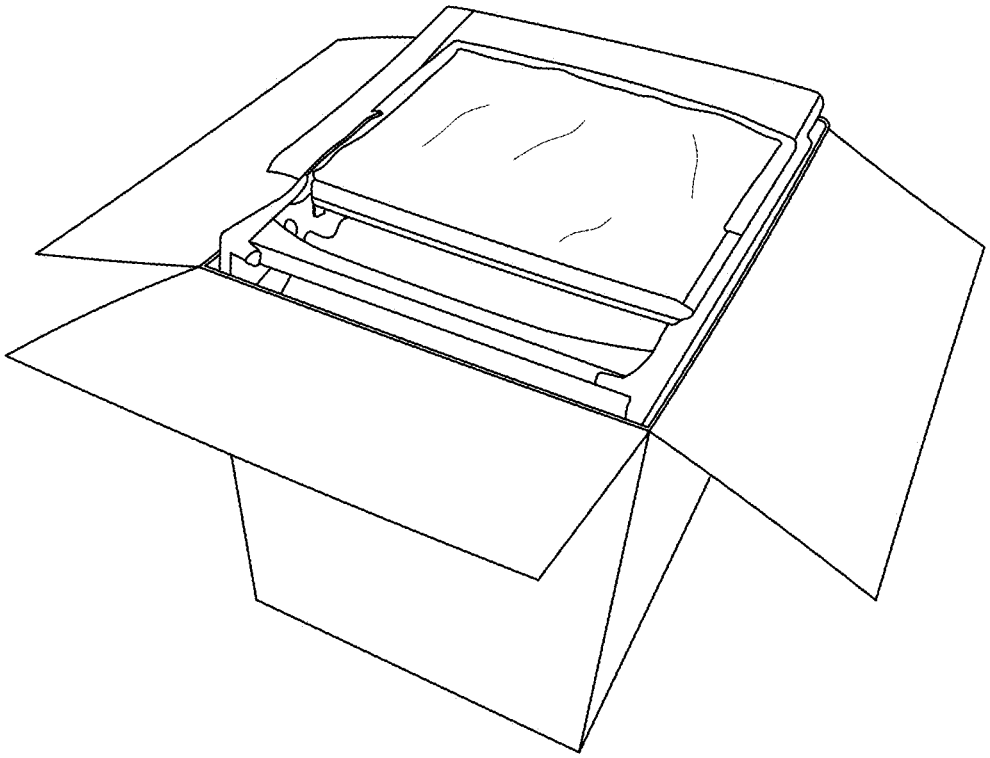
Figure 19B:
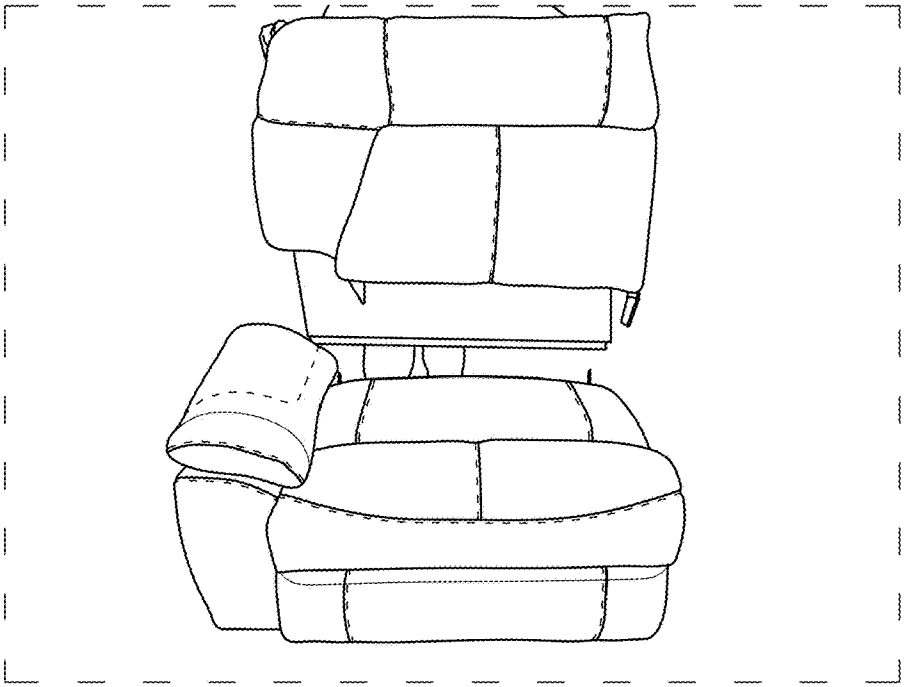
Figure 19A:
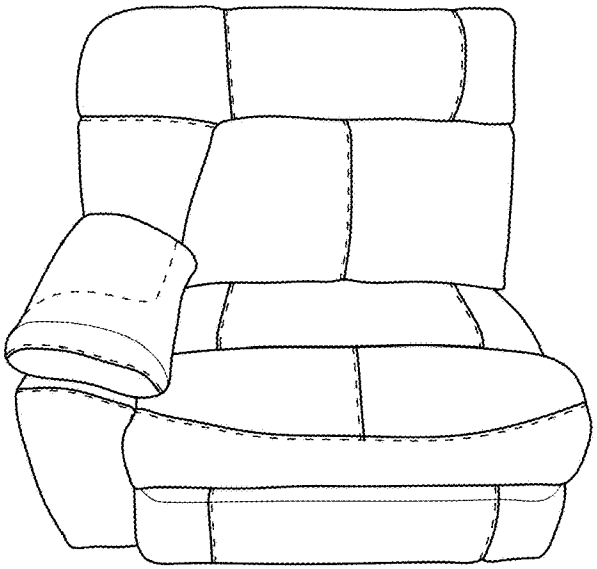
Figure 19D:
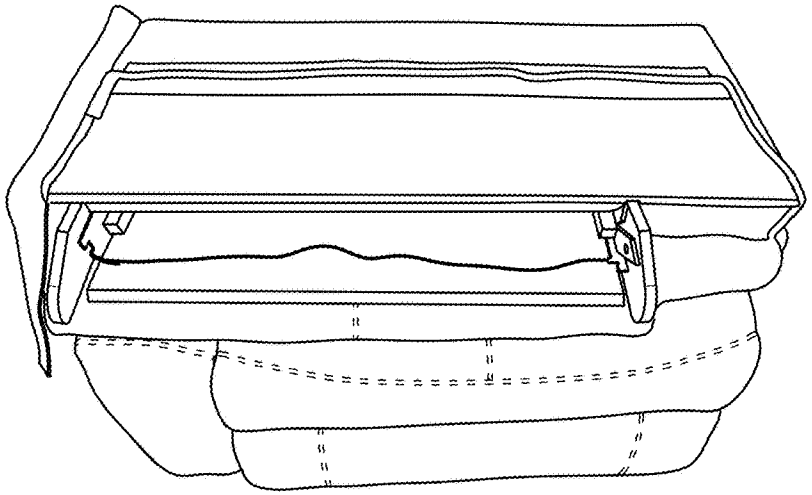
Figure 19C:
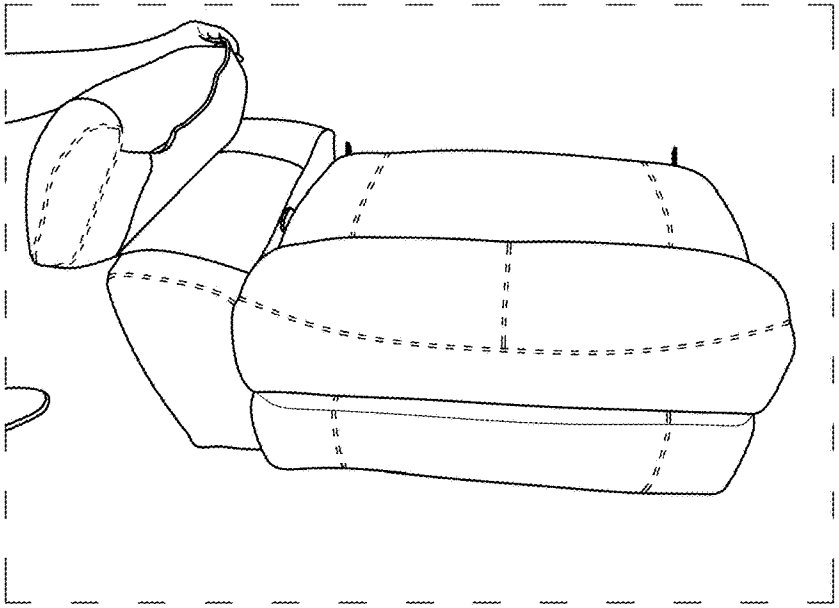
Figure 20B:
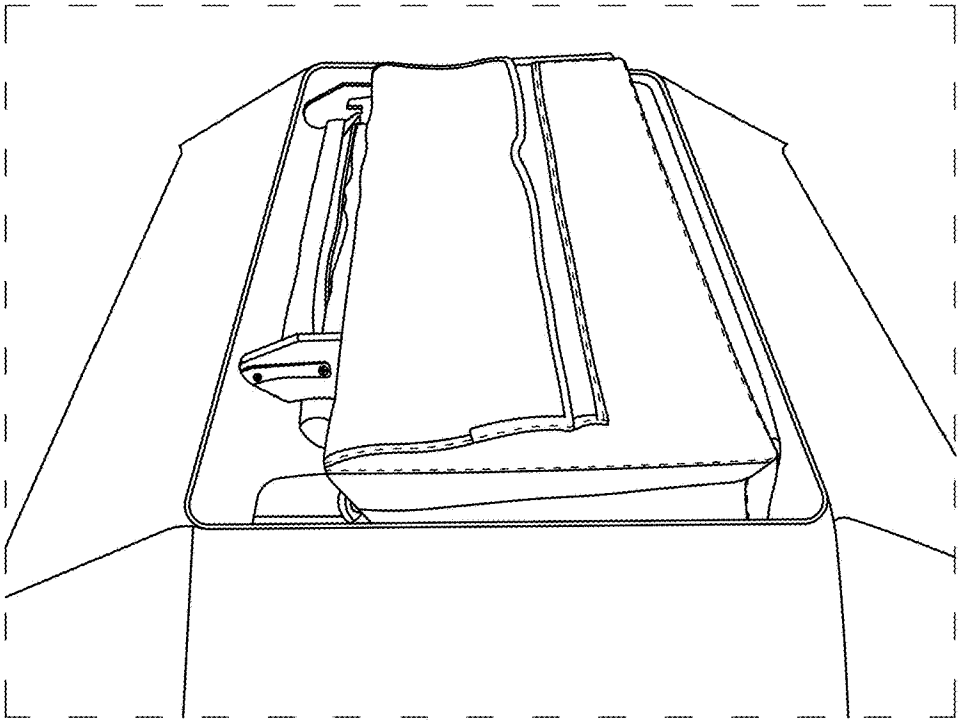
Figure 20A:
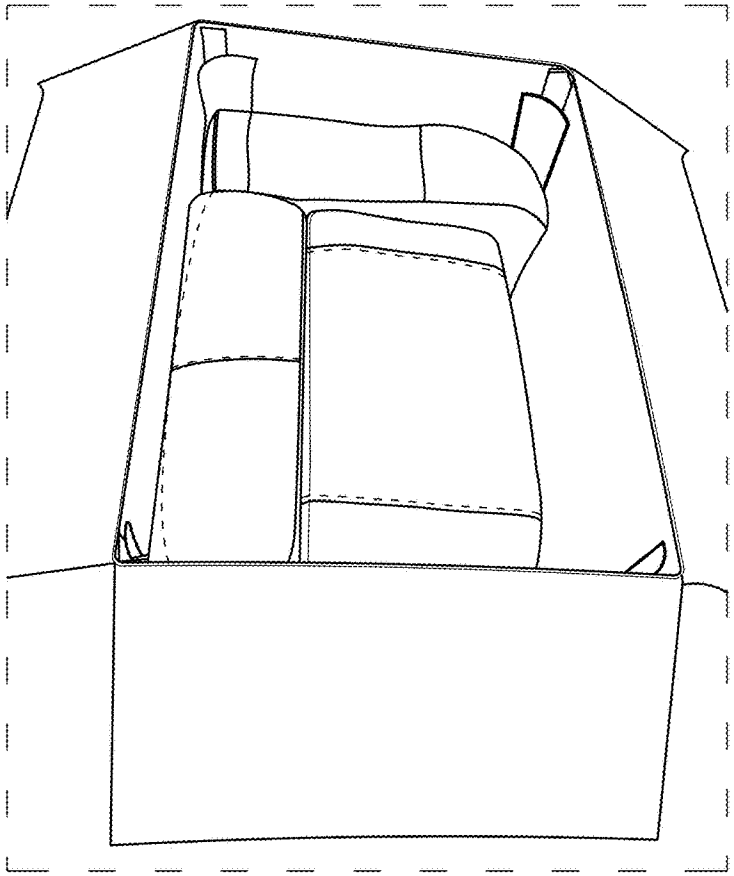
Figure 21B:
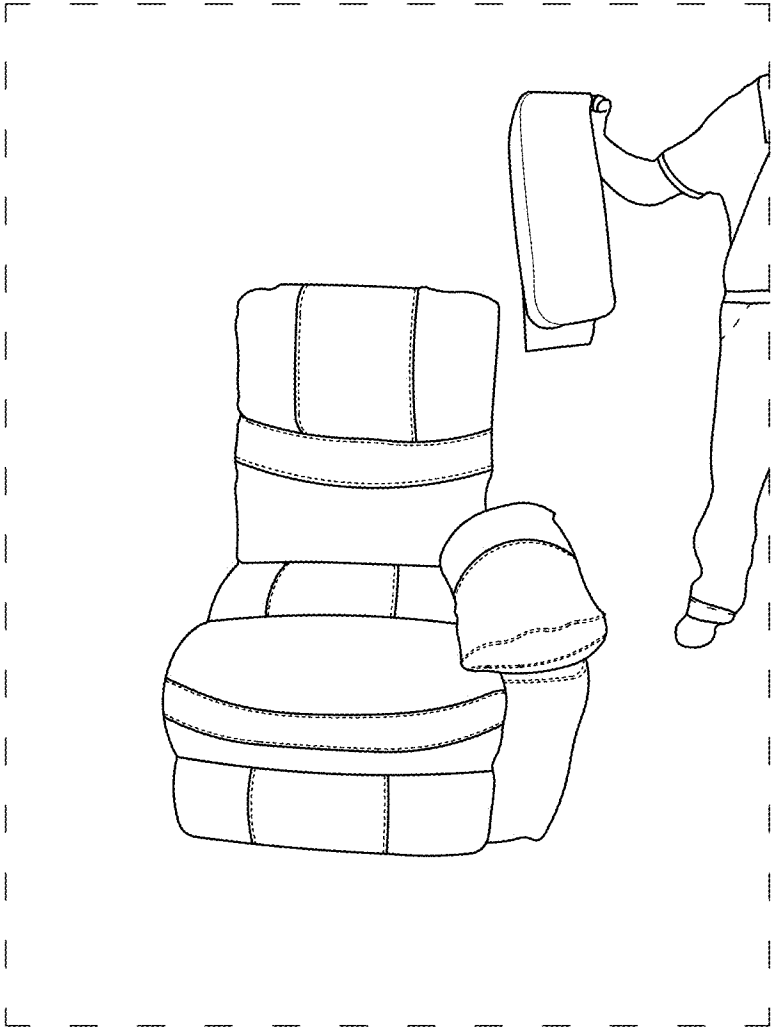
Figure 21A:
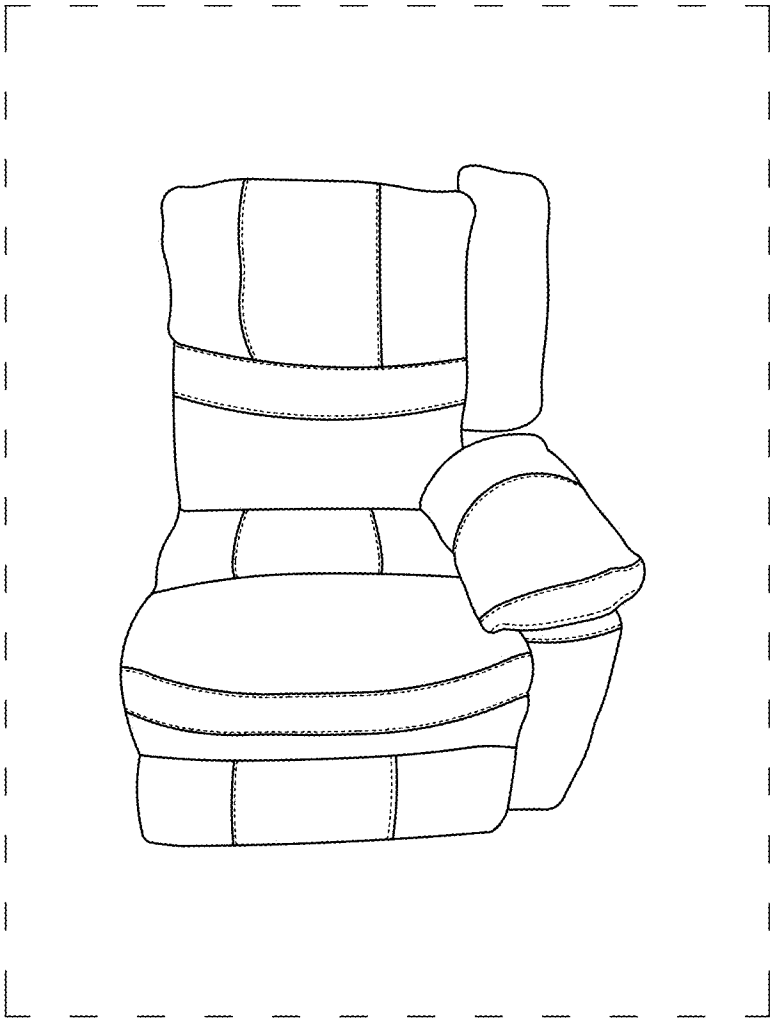
Figure 21C:
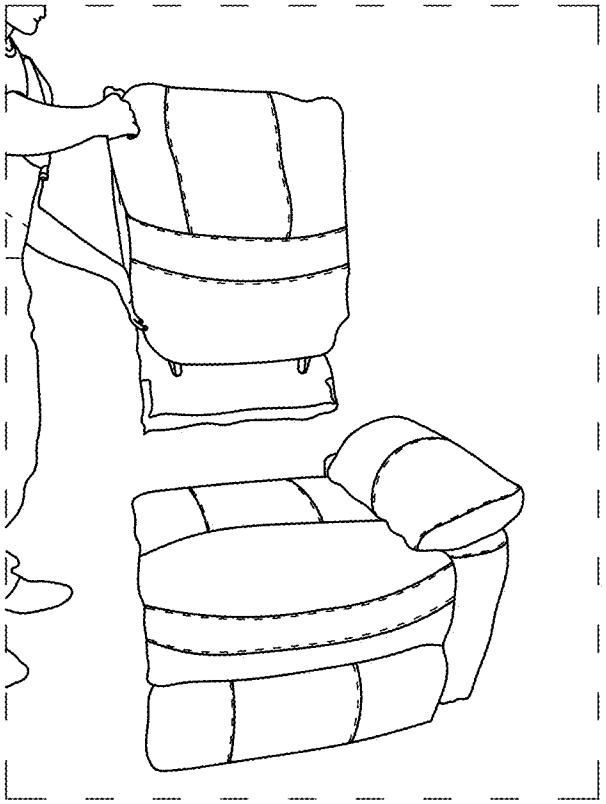
Figure 21D:
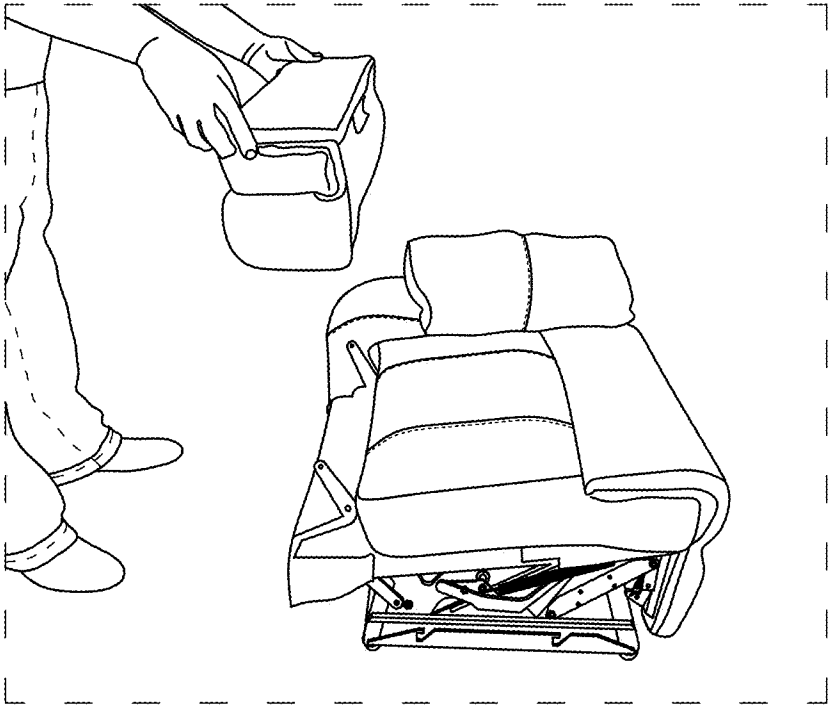
Figure 21E:
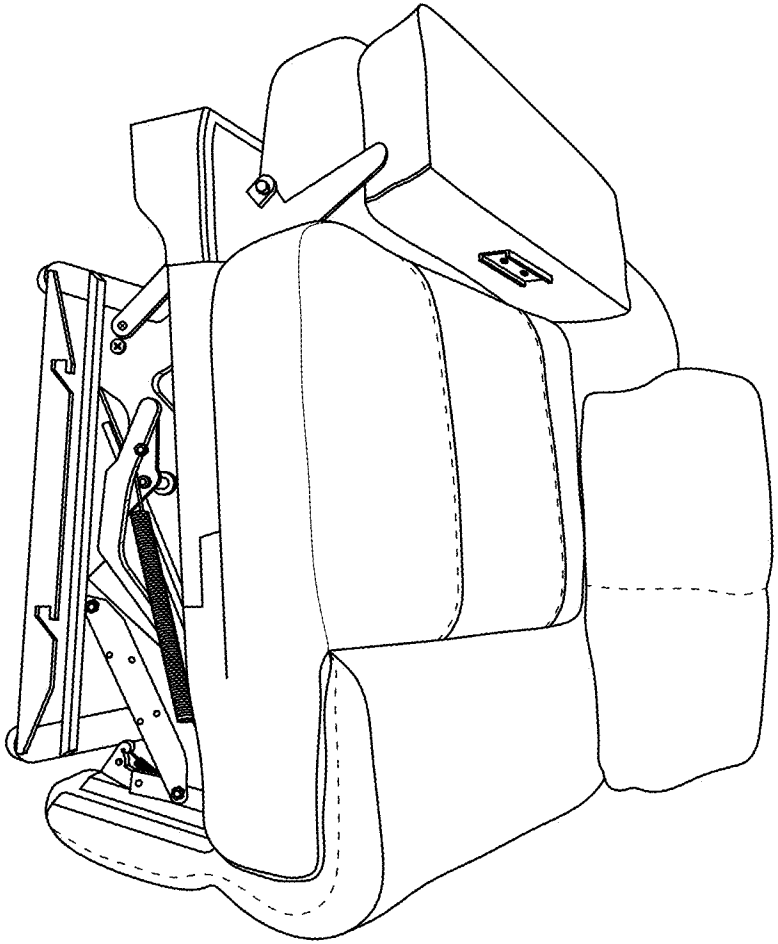
Figure 22B:
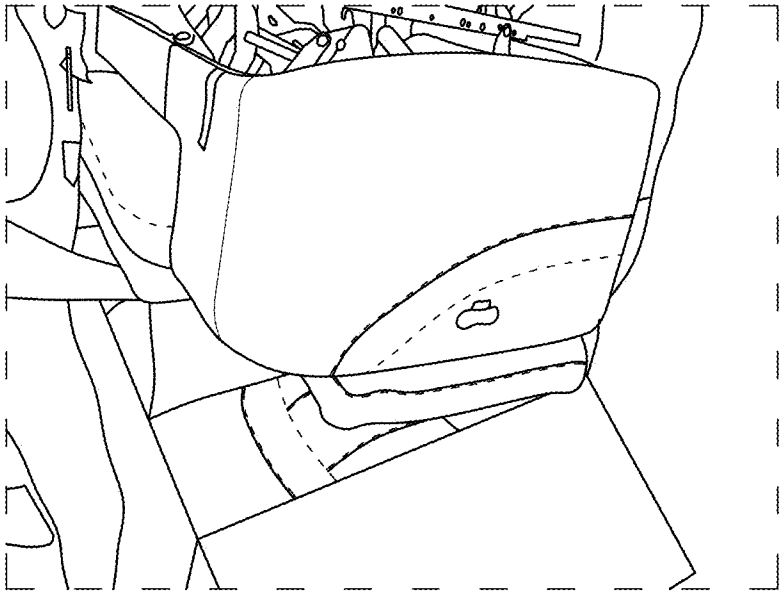
Figure 22A:
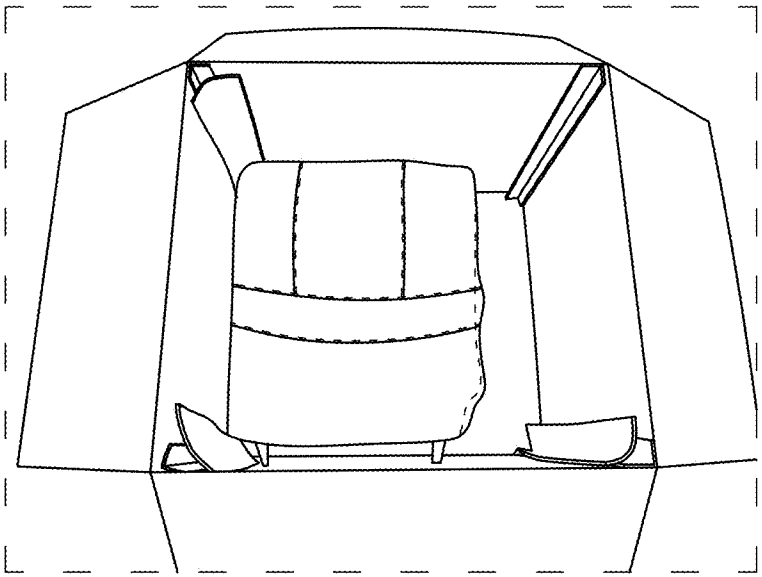
Figure 22C:
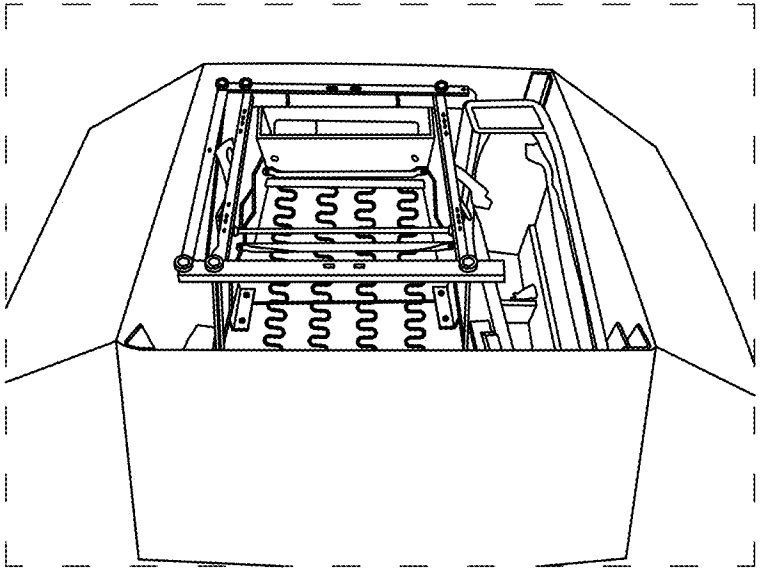
Figure 23B:
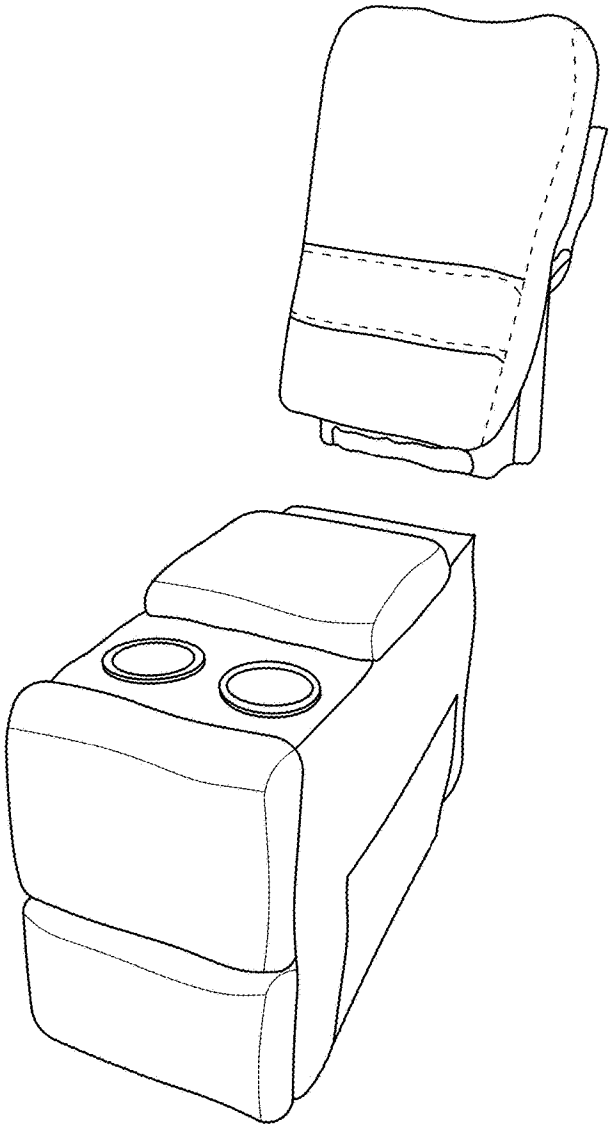
Figure 23A:
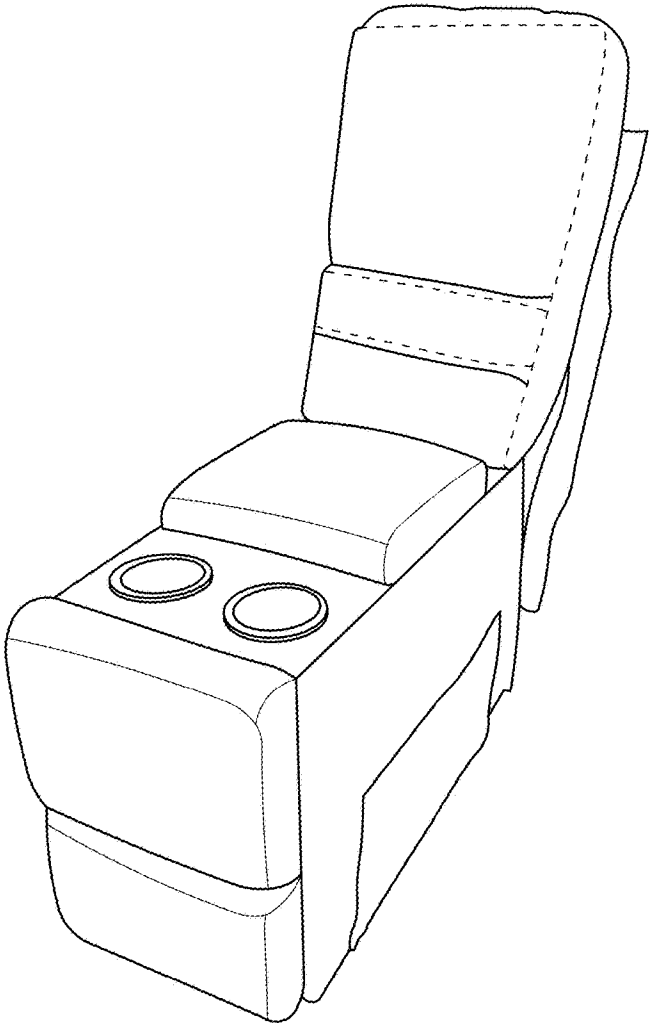
Figure 23D:
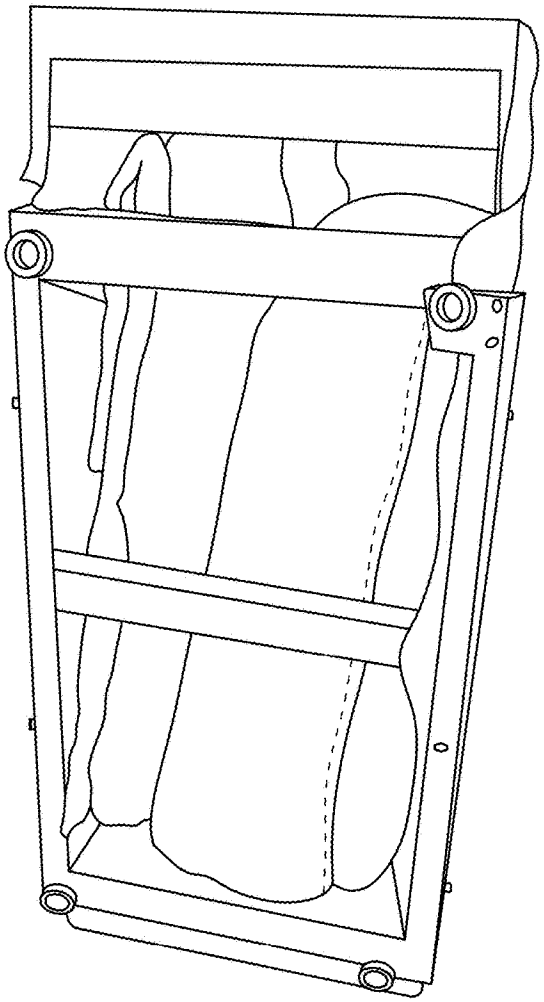
Figure 23C:
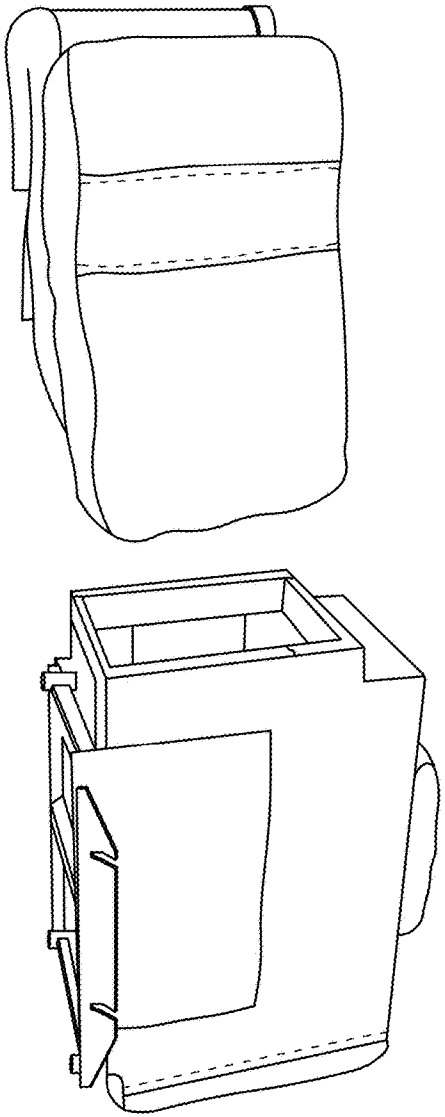
Figure 23E:
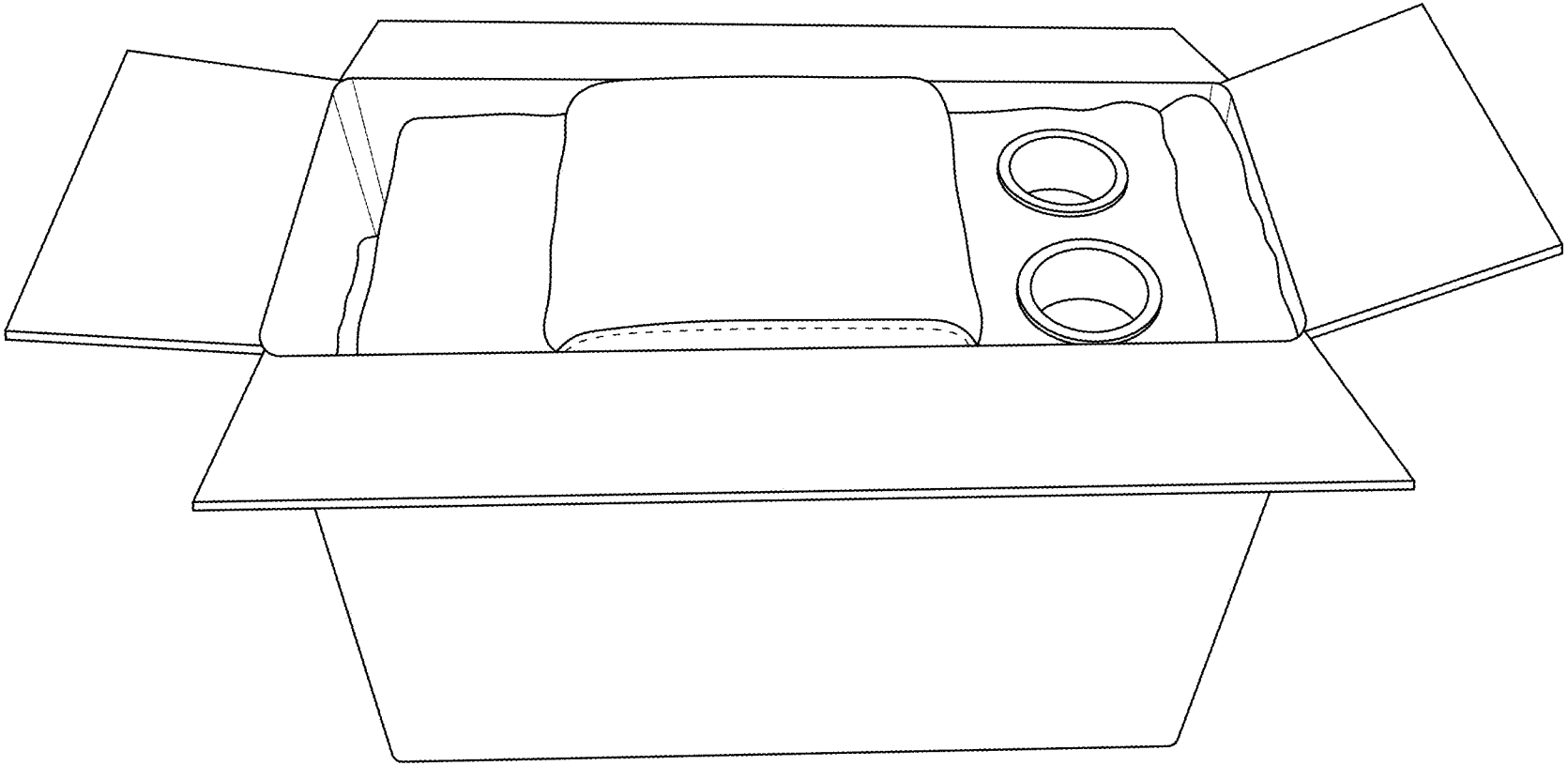

The above RTA construction and packing methodology also can be applied to a "3-over-3" full-sized RTA sofa. FIGS. 13 and 14 show the sofa is a assembled and partially disassembled state, and FIGS. 14-15B show the packing process for packing the sofa in a shipping box or container 10 of 26.5 inches or less in height and 30.6 inches or less in width, with the back assembly followed by the seat assembly, as described above. In several embodiments, a back wing may be removable and stored as described below. Similarly, the above RTA construction and packing methodology also can be applied to a love seat, as seen in FIGS. 16A-B.

Modular Pieces

In several embodiments, the article of furniture may be wholly or partially modular. Modular pieces can be individually and separately disassembled and packaged, as shown in FIGS. 17A-18B (for a modular armless center piece), FIGS. 19A-20B (for a modular end piece), FIGS. 21A-22E (for a modular end piece with a removable back wing, which is placed in the back space created by removal of the back assembly for the shipping configuration) or FIGS. 23A-E (for a modular console).

Access Door

Figure 24B:
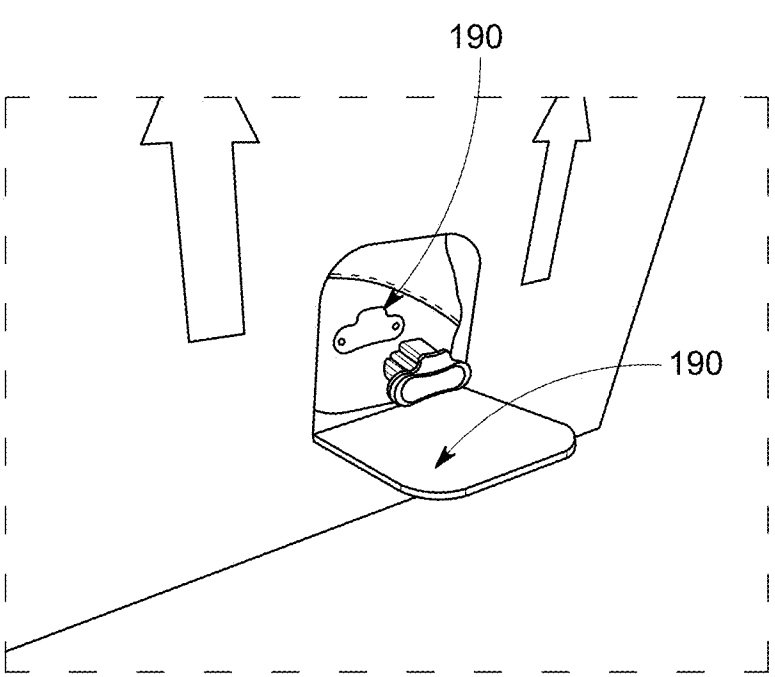
FIGS. 24A-B show operation of an access door on a shipping box.
Figure 24A:
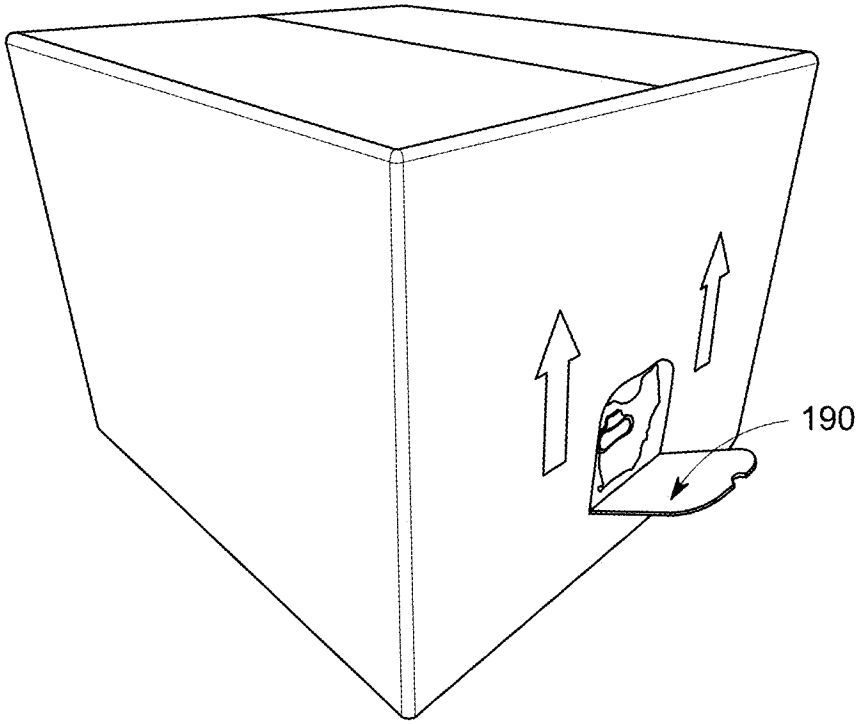

As seen in FIGS. 24A-B, in several embodiments, the shipping box or container has a closable and sealable access door 190 in the side, positioned where the control element connection port 192 for a recliner or other furniture article is located, thereby allowing access to the control element connection port while the furniture article is still in the box. This allows changes to be made, such as adding a power control element added (such as described in U.S. Patent Application No. 62/382,803, which is incorporated herein in its entirety by specific reference for all purposes) without removing the article of furniture from the box.

Container Loading

Examples of various shipping box or container dimensions, and how they can be densely packed on a single standard international cube shipping container, are shown in FIGS. 25A-28C.

As seen in FIGS. 26A-27D, furniture shipping boxes or cartons 26.25 inches in height and 30.5 inches in width and 45 inches in length can be packed in several orientations without reduction in efficiency in space usage. For example, a vertical stack of 8 total such cartons or boxes can be formed with two cartons placed end-to-end in each row (total of four rows). The same cartons can be rotated to form a vertical stack of 12 such cartons or boxes with three cartons placed side-by-side in each row (total of four rows). One or more rows can be replaced by a "long" carton 90 inches in length (such as for a sofa), but the same height and width. The vertical stacks can be repeated to fill the length of the intermodal shipping container.

Figure 28A:
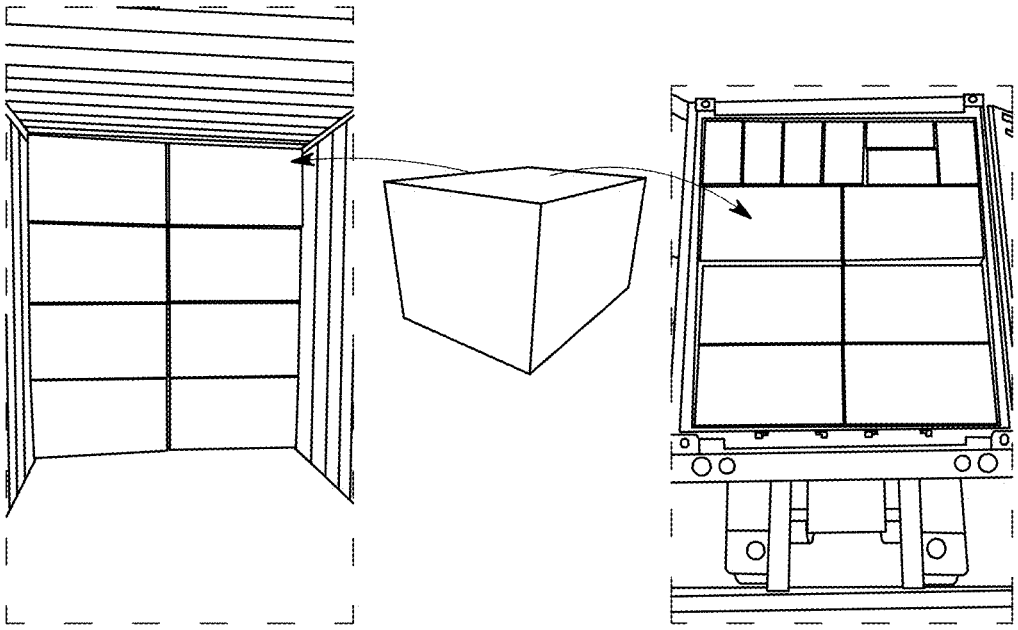
Figure 28B:
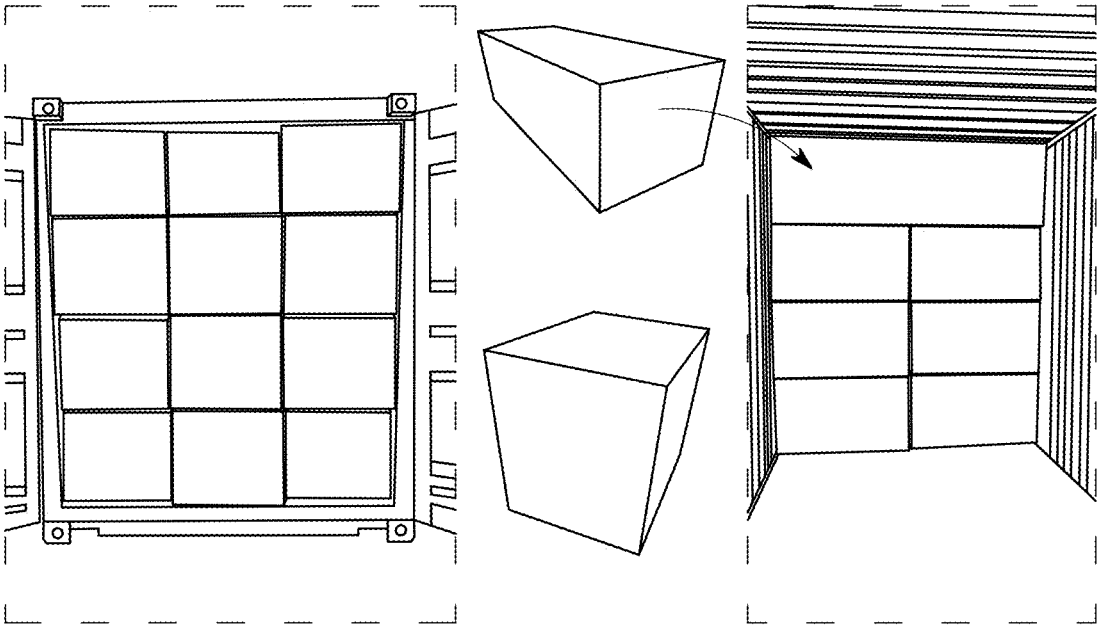
Figure 28C:
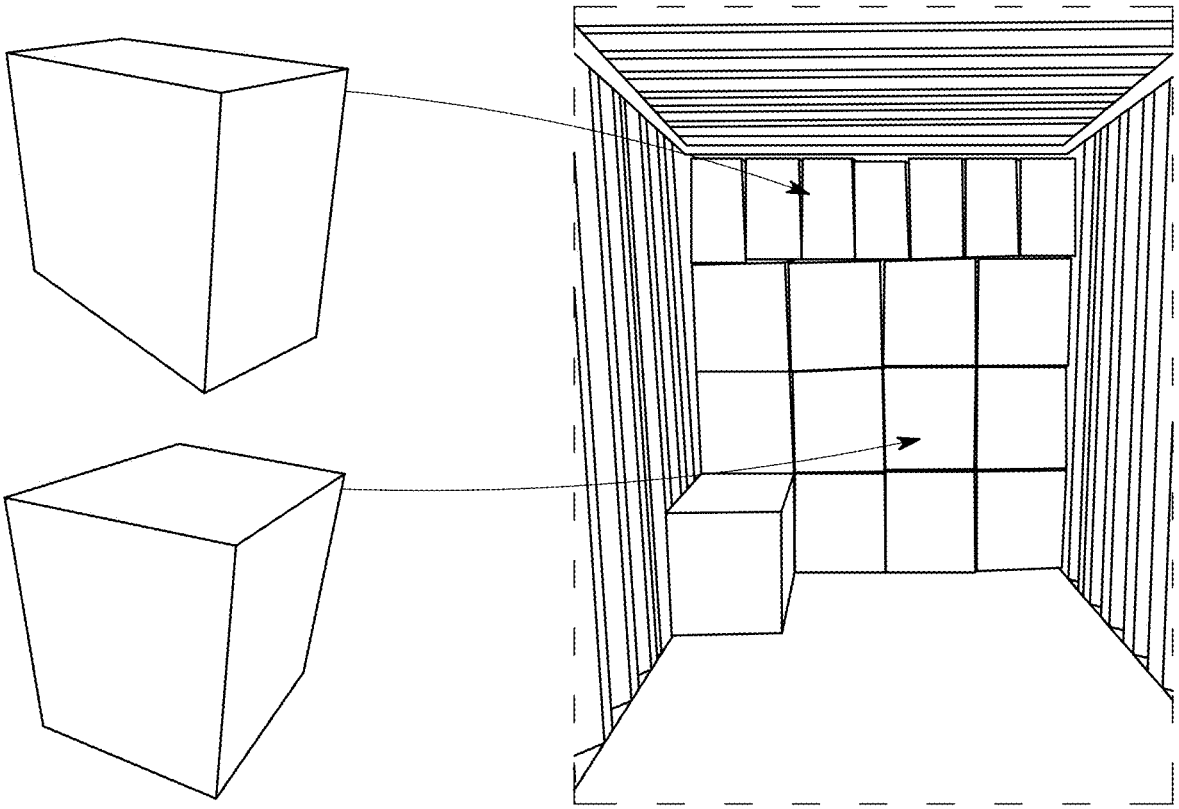

Another compatible shipping box or carton size is 23 inches in length (same 26.25 inches in height and 30.5 inches in width; while the "length" of this carton is the shortest dimension, the reference terminology is the same to emphasize that the "height" and "width" dimensions match those of the other cartons). A "half-size" version of this shipping box or carton is 23 inches in length, 30.5 inches in width, but 13 inches in height. FIGS. 28A-C shows a vertical stack with three rows of the 23 inches long standard boxes (four boxes, end-to-end), with a top row of seven of the half-size boxes. The width/depth of the stack is 30.5 inches. This demonstrates that various sizes of the shipping containers can be packed together in different orientations without loss in packing efficiency.

Figure 25A:
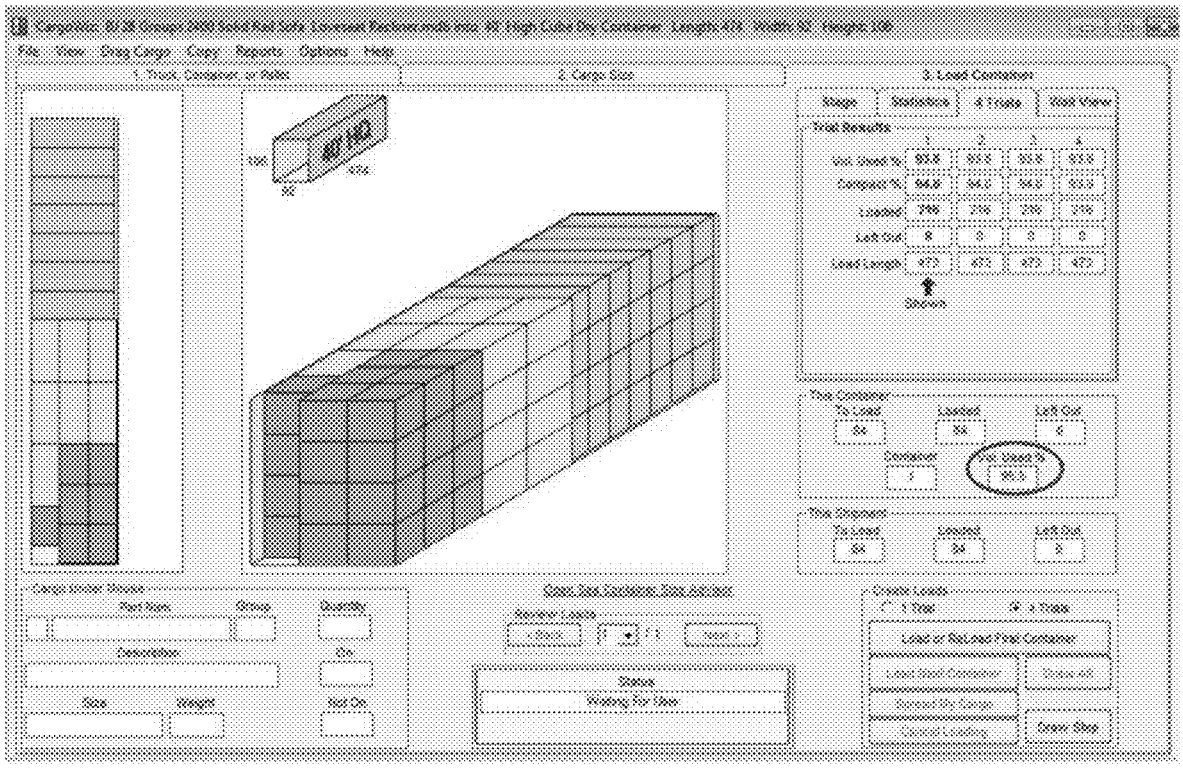
FIGS. 25A-28C show examples of various shipping boxes or containers, and how they can be densely packed on a single standard international cube intermodal shipping container.
Figure 25B:
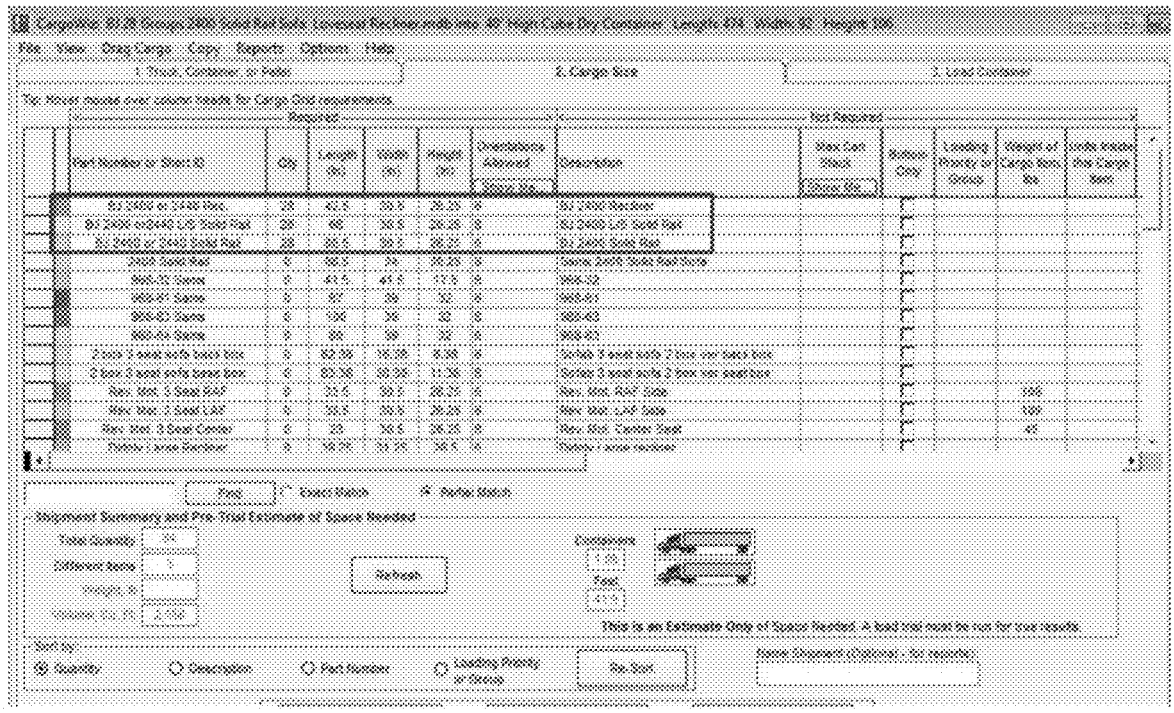
Figure 26B:
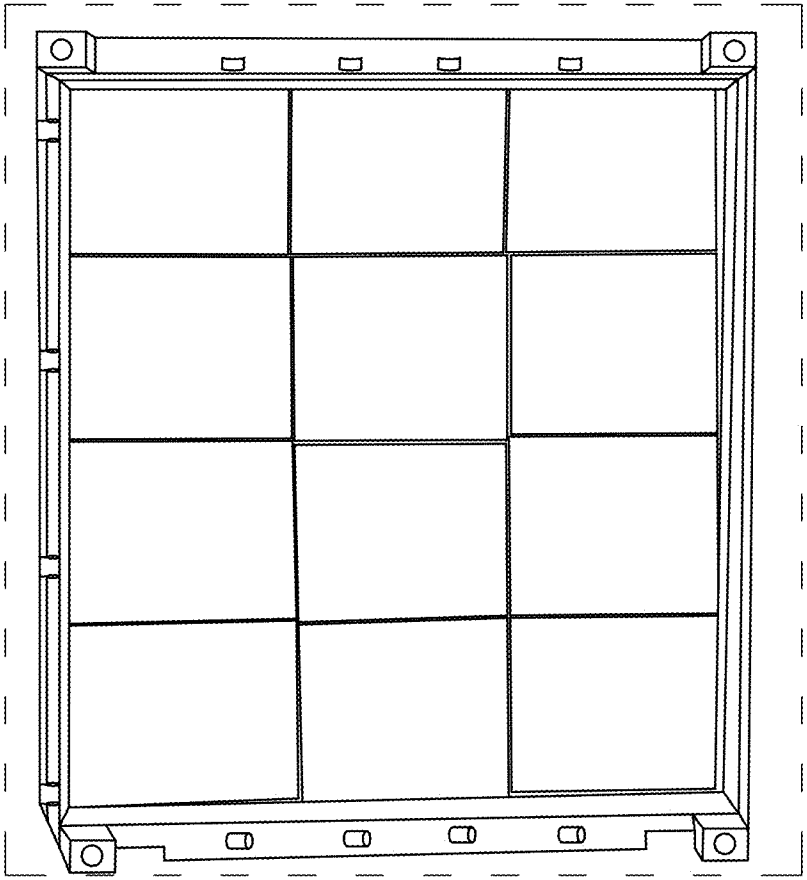
Figure 26A:
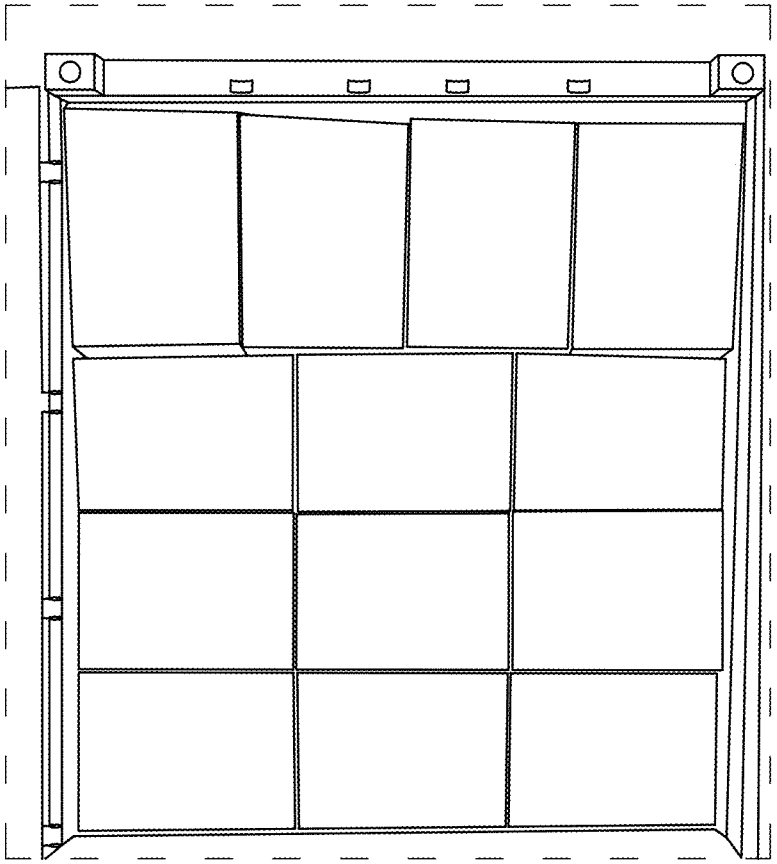
Figure 26D:
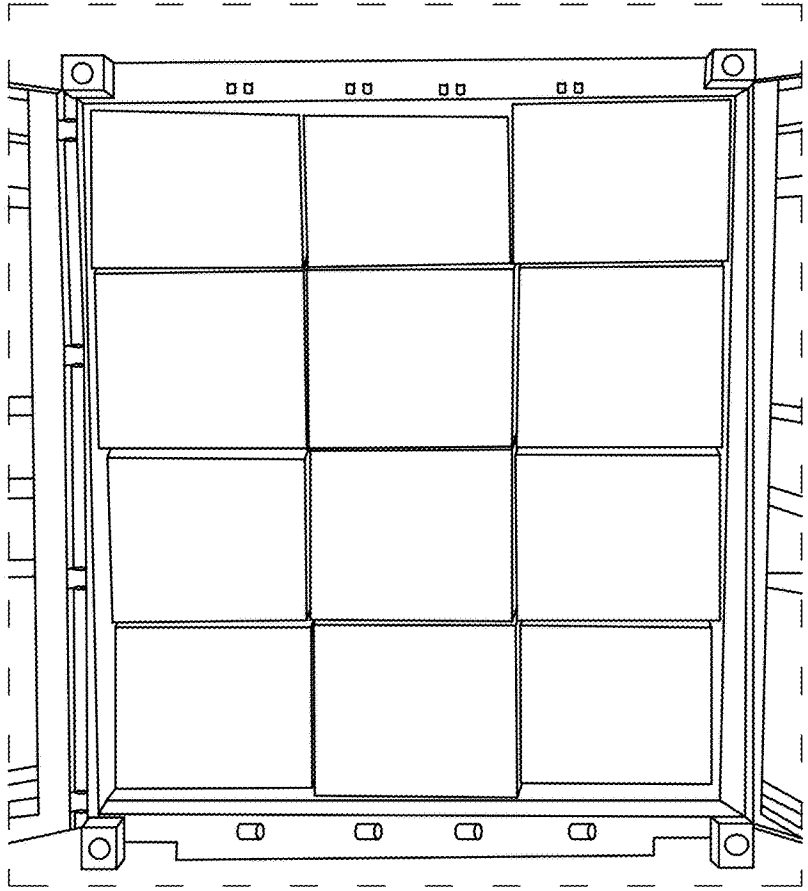
Figure 26C:
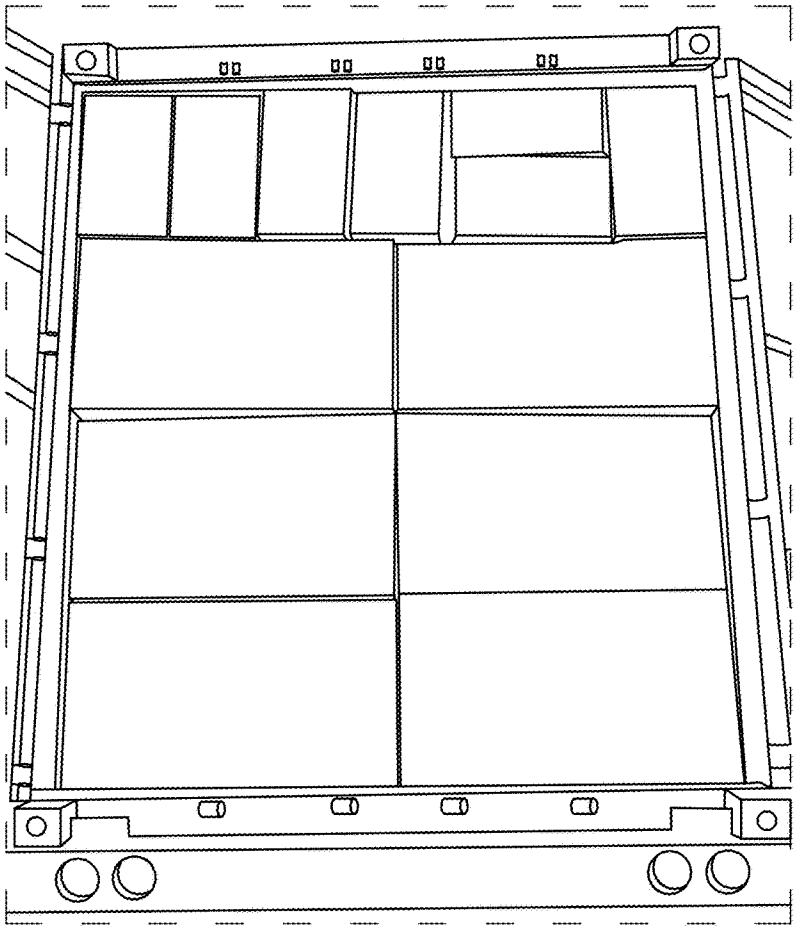
Figure 27B:
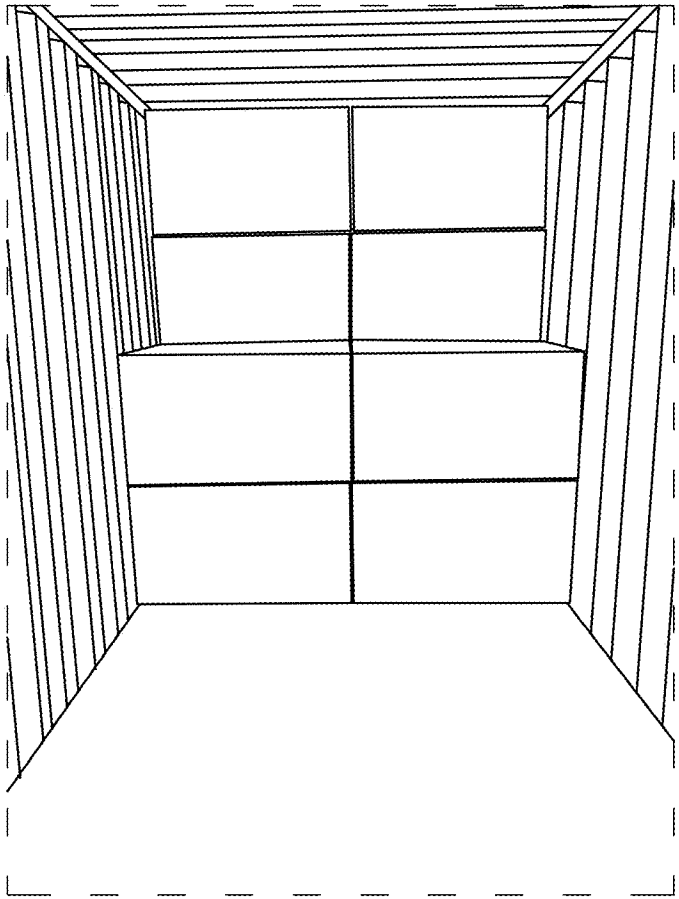
Figure 27A:
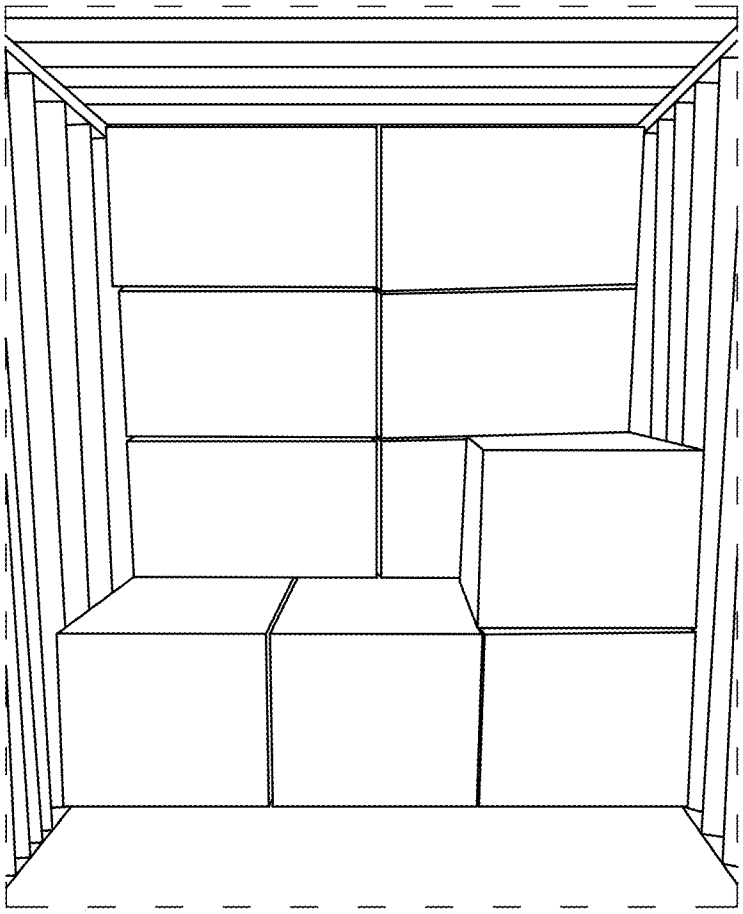
Figure 27D:
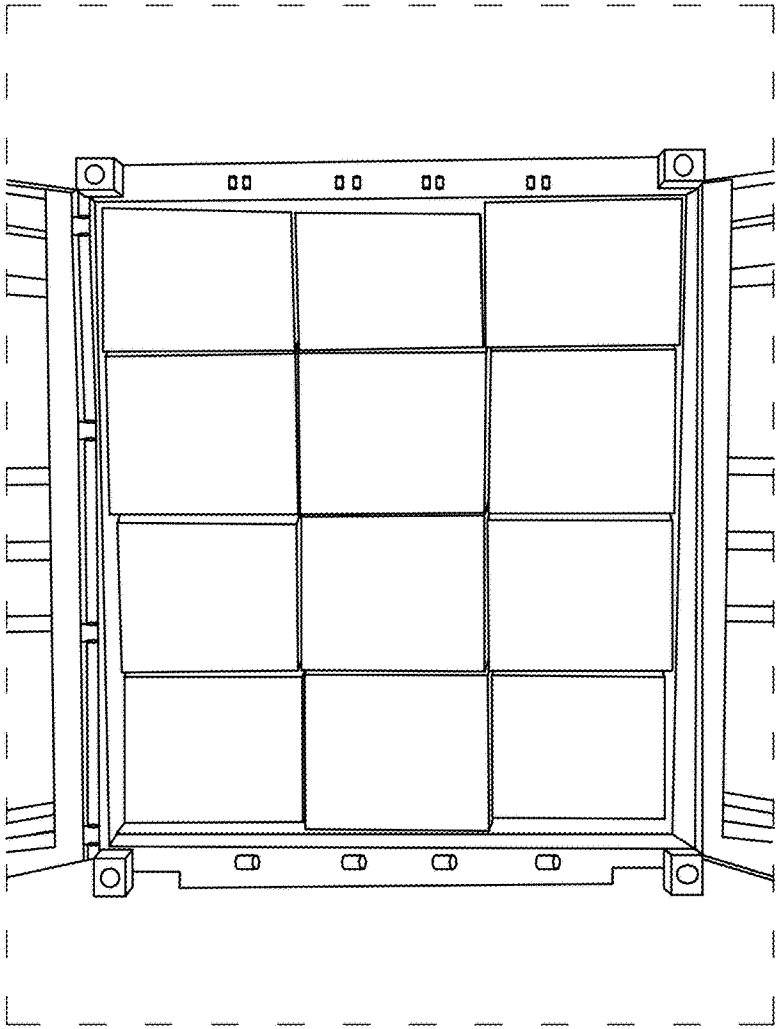
Figure 27C:
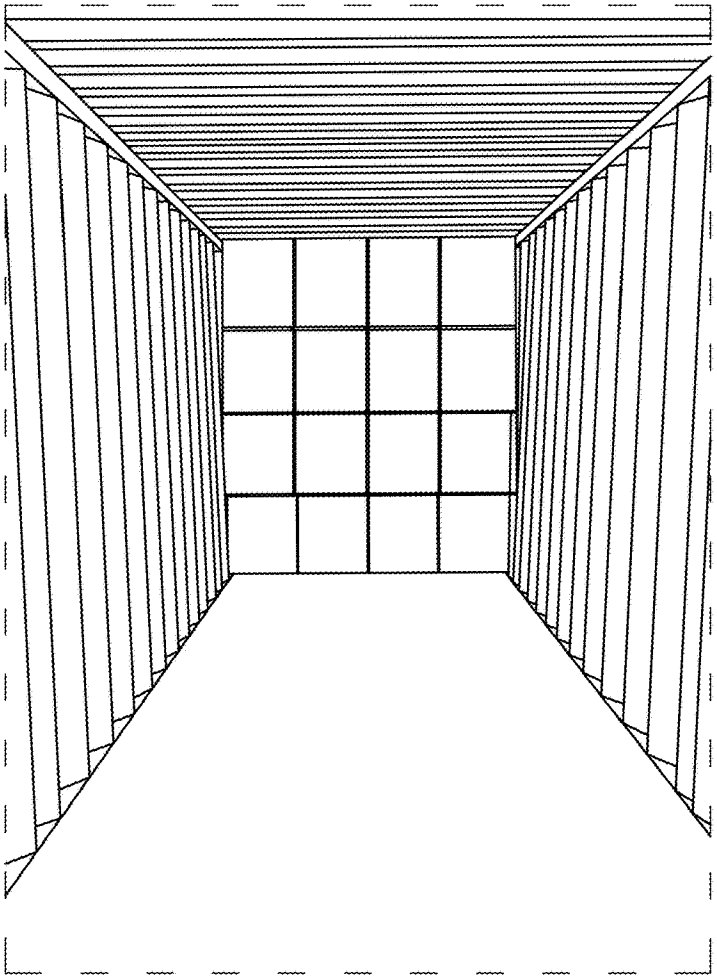

The present invention thus provides for more furniture units to be packed, with greater efficiency, into a single 40 foot long intermodal shipping container. For example, a prior art furniture system can load 19 sofas, 19 loveseats, and 19 recliners (in partially assembled, packed form) on such an intermodal shipping container, while the present invention can load 28 sofas, 28 loveseats, and 28 recliners in the same container, with the assembled furniture being at least as large as the assembled furniture in the prior art furniture system. The packing efficiency, as seen in FIGS. 25A-B, is at least 95.5% (in terms of internal container volume filled/used).

The present system is suitable for all furniture, reclining or non-reclining, where connection is desired, such as, but not limited to, sofas, recliner-sofas, loveseats, recliner-loveseats, chairs, recliner-chairs, sectional pieces, ottomans, rockers, rocker-recliners, gliders, glider-recliners, swivels, swivel rocker, swivel-recliners, and sleeper-sofas, and the like, each with their respective seat boxes and bases.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention. Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. A Ready-To-Assemble furniture system for efficiently transporting a plurality of packed ready-to-assemble furniture in a single shipping container, comprising:

a plurality of shipping cartons of a first configuration, each having a first length, a height of approximately 26.5 inches, and a width of approximately 30.5 inches;

a plurality of shipping cartons of a second configuration, each having a second length, a height of approximately 26.5 inches, and a width of approximately 30.5 inches, wherein the second length is longer than the first length, and the first length is one of approximately 23 inches, approximately 45 inches, or approximately 66 inches, and the second length is one of approximately 45 inches, approximately 66 inches, or approximately 90 inches;

a plurality of first ready-to-assemble furniture items, each first ready-to-assemble furniture item with an assembled configuration and a shipping configuration, wherein in the assembled configuration the respective furniture item is full-size for adults, and in the shipping configuration the respective furniture item has been partially disassembled into one or more components with each of said one or more components arranged and packed into a single shipping carton of the first configuration;

a plurality of second ready-to-assemble furniture items, each second ready-to-assemble furniture item with an assembled configuration and a shipping configuration, wherein in the assembled configuration the respective furniture item is full-size, and in the shipping configuration the respective furniture item has been partially disassembled into one or more components with each of said one or more components of said respective second furniture item arranged and packed into a single shipping carton of the second configuration; and a standard-sized intermodal shipping container with an internal width of 92 inches and an internal height of 106 inches and an internal length of 474 inches, said intermodal shipping container configured to receive at least four shipping cartons of said first configuration and at least four shipping cartons of said second configuration, each shipping carton containing a corresponding ready-to-assemble furniture item in a corresponding shipping configuration, in a dense packing arrangement;

wherein the dense packing arrangement has a packing efficiency that exceeds 95.5% with respective to internal space of the intermodal shipping container;

further wherein at least one of said plurality of first furniture items comprises at least two components that are connected by snap-fit fasteners and connectors when in said corresponding assembled configuration; and further wherein at least one of said plurality of second furniture items comprises at least two components that are connected by snap-fit fasteners and connectors when in said corresponding assembled configuration.

2. The furniture system of claim 1, wherein the respective first furniture item or the respective second furniture item comprises a base assembly, a back assembly, and a seat assembly, wherein the base assembly, back assembly, and seat assembly are connected by snap-fit connectors in said assembled configuration.

3. The furniture system of claim 1, further comprising at least one foam insert with one or more slots or holes configured to securely receive one or more elements of said one or more components of said first and/or second furniture items in said respective shipping configurations.

4. The furniture system of claim 1, wherein at least one of said first shipping cartons further comprises a closable and sealable access door in a side of the shipping carton, configured to allow access to a control element connect port in a component of the respective item of furniture in the corresponding shipping configuration while in the at least one of said first shipping cartons.

5. The furniture system of claim 1, wherein said first and/or second items of furniture comprise one or more of the following: sofas, recliner-sofas, loveseats, recliner-loveseats, chairs, recliner-chairs, sectional pieces, ottomans, rockers, rocker-recliners, gliders, glider-recliners, swivels, swivel rocker, swivel-recliners, and sleeper-sofas.

6. The furniture system of claim 1, wherein said first and/or second item of furniture is a recliner with a back assembly with a cushion side and right and left wing cushions, a seat assembly a right arm with a cushion and a left arm with a cushion, said seat assembly further comprising a cushion side and a base side, and a base assembly with a top side;

further wherein the shipping configuration for said recliner when placed in the corresponding shipping carton comprises, from a bottom of the corresponding shipping carton: (1) the back assembly with cushion side up; (2) the seat assembly with cushion side down, with the right arm and left arm aligned with the right and left wing cushions; (3) at least one foam insert with one or more slots or holes; (4) the base assembly with top side down and rotated 90 degrees with respect to the seat assembly when in the assembled configuration.

7. The furniture system of claim 1, wherein the arrangement of components in the shipping configuration of the first and/or second items of furniture is inverted.

8. The furniture system of claim 1, wherein one of said first and/or second items of furniture comprise one or more arm components, wherein said arm components are hollow and configured to receive one or more pillows or cushions from the respective item of furniture when in the respective shipping configuration.

* * * * *